US008157981B2

(12) United States Patent
Peters et al.

(10) Patent No.: US 8,157,981 B2
(45) Date of Patent: Apr. 17, 2012

(54) ELECTROLYTIC SYSTEM AND METHOD FOR ENHANCED RELEASE AND DEPOSITION OF SUB-SURFACE AND SURFACE COMPONENTS

(75) Inventors: Michael J. Peters, Bailey, CO (US); David D. Faulder, Littleton, CO (US)

(73) Assignee: Strategic Resource Optimization, LLC, Bailey, CO (US)

( * ) Notice: Subject to any disclaimer, the term of this patent is extended or adjusted under 35 U.S.C. 154(b) by 1377 days.

(21) Appl. No.: 11/603,659

(22) Filed: Nov. 22, 2006

(65) Prior Publication Data

US 2008/0115930 A1 May 22, 2008

(51) Int. Cl.
*C02F 1/46* (2006.01)

(52) U.S. Cl. ..... 205/687; 205/688; 205/696; 205/746; 204/252; 204/263

(58) Field of Classification Search ..... 205/687, 205/688, 696, 746; 204/252, 263
See application file for complete search history.

(56) References Cited

U.S. PATENT DOCUMENTS 3,782,465 A 1/1974 Bell et al.
3,819,329 A 6/1974 Kaestner et al.
3,915,819 A 10/1975 Bell et al.
3,923,629 A 12/1975 Shaffer
4,310,406 A 1/1982 Smith et al.
5,445,722 A * 8/1995 Yamaguti et al. ..... 204/228.6
6,869,539 B2 * 3/2005 Sheets ..... 210/747
2005/0199387 A1 9/2005 Wittle et al.
2005/0217990 A1 10/2005 Sibbett et al.

OTHER PUBLICATIONS

International Search Report for PCT/US2007/085088 dated Nov. 7, 2008.
Larry W. Lake, Enhanced Oil Recovery, Selected Sections, Prentice Hall, New Jersey, pp. vi-vii, xii-xvii, 354-423.
DiCarlo, et al., "Three-Phase Relative Permeability of Water-Wet, Oil-Wet, and Mixed-Wet Sandpacks," SPE Journal, vol. 5, No. 2, Mar. 2000, pp. 82-91.

* cited by examiner

*Primary Examiner* — Arun S Phasge
(74) *Attorney, Agent, or Firm* — Belair & Perrone LLP

(57) ABSTRACT

The present electrolytic system and method for extracting components includes a means for providing a carrier fluid; a means for providing a pair of electrodes interposed by a permeable membrane to create a first channel and a second channel; a means for flowing the carrier fluid through the first and second channel; a means for applying a voltage to the pair of electrodes to produce a first ionized carrier fluid in the first channel and a second ionized carrier fluid in the second channel; a means for injecting at least one of the first ionized carrier fluid and the second ionized carrier fluid into the subsurface reservoir to release the components; and a means for recovering the at least one of the first ionized carrier fluid and the second ionized carrier fluid and the components from a subsurface strata or ex-situ mineral deposit.

38 Claims, 13 Drawing Sheets

ELECTROLYTIC SYSTEM AND METHOD FOR ENHANCED RELEASE AND DEPOSITION OF SUB-SURFACE AND SURFACE COMPONENTS

FIELD OF THE INVENTION

This invention relates to the recovery and deposition of hydrocarbons, fluids, solid minerals, and other components in the subsurface or ex-situ by the direct introduction of a charged fluid, and more particularly to the recovery of hydrocarbons from geologic media.

BACKGROUND OF THE INVENTION

It is a problem in the field of fluid and solid mineral extraction to efficiently extract subsurface components in subsurface deposits, reservoirs, or fields. For example, the oil industry typically produces only about one-third of the original oil in place ("OOIP") from a field before it is considered "depleted." The termination of recovery operations from depletion is really driven by declining oil recovery until an economic limit is approached and the recovery operation is terminated or mothballed. Thus, the majority of oil remains un-recovered though discovered, identified and with direct physical access by existing wells. World oil demand is expected to jump an estimated 50% by 2025, according to the U.S. Department of Energy, and it is most unlikely that current production and extraction technology will be able to supply this increased demand of the world's growing requirements and economies.

Many extraction technologies have been employed to improve the recovery from known and developed fields as they near their economic production limit. For example, the improved oil recovery ("IOR") processes involve two general technology pathways: solvent or immiscible fluid displacement methods. Solvent based methods involve the injection of hydrocarbon gases, carbon dioxide, or other substances that rely on the injected fluid becoming miscible and dissolving into the liquid hydrocarbon. This technological pathway is expensive due to the costs of producing, processing, transporting, compressing, injecting, and recycling of valuable substances to recover additional hydrocarbons.

Immiscible displacement technologies, such as water flooding, use water directly as a displacement fluid. To release incremental oil from a reservoir, externally derived substances, such as chemicals, surfactants, polymers, and alkaline materials (among others) are often added to change the fluid and rock petrophysical properties during a water flood. These chemicals change the flow properties and may improve the microscopic displacement by increasing the water wettability at the pore level. At the pore scale, rock-fluid interactions and solid-liquid surface effects become a significant factor in water wettability modifications. Increasing the water wettability of a substrate will release additional oil from pore surfaces that can be recovered by the general water flood process.

Surfactants have been used to improve displacement-based technologies by altering the flow and properties at the solid-liquid interface. The surfactant penetrates the pore scale internal structure to reduce the amount of oil trapped by capillarity, other surface-liquid forces and liquid-liquid forces. The interfacial tension between the water and oil phases is reduced, thus increasing the water wettability of the substrate. The incremental displaced oil is then captured by the general water flood process and transported for recovery. The reduction of interfacial tension increases the water saturation as smaller pore spaces undergo water imbibition that enhances the direct expulsion of oil from a pore space. This results in pore and capillary scale mobilization and displacement of the oil phase and improves oil displacement efficiency. Various other benefits may occur depending on the chemical interaction of the surfactant and the hydrocarbon phase. These include modification of the multi-phase flow mobility by increasing rock-water wettability and changes in the relative permeability relationship. One limitation is the significant cost of surfactants in relation to the benefits gained. Technical limitations of this approach include surfactant adsorption on the rock/solid interface and the effect of calcium/magnesium (e.g., hard water) interactions in the subsurface. This latter effect can simply be described by the reduction of surfactant effectiveness in the presence of hard water.

Polymers have been used to improve the displacement process by modifying the two-phase mobility of the injected fluid, such as water, thus increasing its fluid viscosity to achieve a more uniform displacement front and improved volumetric/macroscopic fluid sweep efficiency. Polymers generally do not result in a change in the rock wettability or change the residual non-wetting phase saturation relative to the permeability endpoint. As with other chemical additive methods, the cost of the polymers is a significant disadvantage. The polymers must be precisely mixed to generate the desired effect in the subsurface. Additional limitations exist from adsorption of the polymer by the substrate and ineffectiveness in reducing oil saturation.

Alkaline substances entrained in the injected fluid have also been used to improve oil recovery. Alkaline flooding or high pH methods typically use hydroxide anions (OH) or weakly dissociating acids to reduce the concentration of hydrogen ions ($H^+$) from the solution. The introduction of a high pH solution into a reservoir results in a disassociation of a hydroxyl-containing species that preferentially bind hydrogen ions and the creation of a surfactant as a reaction occurs between the oil and the alkaline fluid. An increase in water wettability of the porous media directly displaces hydrocarbons from the porous media. Alkaline flooding uses chemicals like sodium hydroxide, sodium orthosilicate and sodium carbonate to generate solutions having a sufficiently high pH. A typical alkaline flood design may use concentrations of up to 5% and a slug size of 0.2 pore volumes to achieve a beneficial effect. The quantity of chemicals needed for this application is significant and the costs of implementation reflect this requirement. Technical limitations of this approach (beyond the logistics of substantial chemical handling include consumption of the alkaline materials by the geologic media, requiring additional chemicals to maintain the expected benefit.

Other chemical methods include petroleum sulfonates that are produced by combining crude oil or intermediate molecular weight hydrocarbons with $SO_3$ gas to yield a highly acidic solution that in turn produces anionic surfactants. These anionic surfactants are dissolved in an aqueous solution, thus producing a cation and a monomer, which forms a micelle. When the micellar solution contacts the oleic phase, the surfactant accumulates in the pore, lowering the interfacial tension between the oil and water phases. This results in an increase in the water wettability and the displacement of oil from the pore. As with other techniques, a limitation of this approach is the significant cost of producing and transporting the sulfonates in relation to the benefits gained. One of the technical limitations is the stability of the micelle during flood displacement.

Low salinity flooding has been used to improve oil recovery by diluting the connate brine (existing in-situ brine within the strata) with lower salinity water. The lowering of salinity increases the pH and increases water wettability and the subsequent displacement of hydrocarbons from the porous media. This process has been noted to act similar to an alkane flood by increasing the water wettability of the rock-liquid interface. The reduction of salinity can be accomplished by dilution or more commonly by the use of reverse osmosis (RO) processes. This approach is both capital intensive and has a significant operational cost burden for the duration of the operation. Technical limiting factors are the large capacity of the RO systems required and the limitation of the dilution effect within the formation.

While the above examples are related to oil recovery, other fluid and solid mineral resource recoveries are faced with similar issues. Mineral recovery efficiency is hampered by both technical and economic hurdles. This has impeded the overall development of the resource endowment and improvements in extraction efficiency.

Current state-of-the-art processes rely on the introduction of externally derived materials (e.g., chemicals) to alter the bonding state of the solid-liquid interface of solid mineral and other components in the subsurface to release/recover the components of interest. These applications have increased recovery efficiencies, but are approaching both technical and economic limits. The introduction of external materials added for extraction may have unwanted (physical, geochemical, petrophysical or other) side effects that limit extraction efficiency and/or create environmental damage. This invention will reduce capital and operating costs while improving the recovery of subsurface components.

BRIEF SUMMARY OF THE INVENTION

The above-described problems are solved and a technical advance achieved in the field by the present Electrolytic System and Method For Enhanced Release and Deposition of Sub-Surface and Surface Components (termed "electrolytic component removal system" herein), which functions to directly, variably, and reversibly change the electrochemical state of a carrier fluid to substantially aid and increase the recovery, deposition, concentration or sequestration of a wide range of subsurface components, such as fluids and minerals, or for use in surface processing. This is accomplished by directly altering the electrochemical state of subsurface components and changing the Zeta potential at the solid-liquid interface, solid-mineral interface, liquid-liquid interface, or strata. The carrier fluid is ionized prior to utilization by the addition or removal of electrons from the system (depending on application). The electrolytic component removal system uses an ionized carrier fluid to release/recover minerals and other components from the subsurface, and can also be utilized for above ground processing for beneficial, economic, and environmental utility.

This present invention, the electrolytic component removal system, directly acts on the electrochemical charge balance between the solid-liquid/solid-mineral interface to reversibly alter the electrochemical potential and overcome the technical impediments to efficiently increase fluid and mineral resource recoveries. The present electrolytic component removal system directly modifies the electrochemical properties of introduced or connate water to recover fluid or solid minerals and increase the extraction efficiency by controlling the electrochemical charge that trapped the deposit over geologic time. The electrolytic component removal system adjusts the electrochemical state of the carrier fluid to address variations in bonding potential that release the fluid and mineral components for improved recovery.

In one aspect, the present electrolytic component removal system uses immiscible displacement flow theory as a method for removing and transporting subsurface components through a porous or subterranean media and to deliver the change in electrochemical charge. The present electrolytic component removal system may be applied to a wide range of subsurface mineral extraction and environmental issues where controlling the charge balance results in beneficial outcomes. This may include the recovery and release of fluid and/or solid minerals, the remediation or sequestration of pollutants, alteration or enhancement of biological activity and improvement in process operations. The present electrolytic component removal system also includes mineral components that are mined or processed on the surface. The electrochemical carrier fluid may be used in surface processing operations to improve mineral extraction and recovery.

The present electrolytic component removal system controls the electrochemical state of subterranean geologic strata by ionizing a carrier fluid prior to its injection into the formation of interest. The ionized carrier fluid can use either a negative or reducing potential (excess of electrons) or a positive or oxidizing potential (lack of electrons), and the amount of charge can be adjusted to control a recovery or other operation. A fluid ionizer generates both solutions from the split stream exiting the ionizer subsystem. The electrical potential of the solutions can be controlled by adjusting current density, total dissolved solids, plate size and type, membrane type, voltage, fluid residence time, or a combination of these variables. This allows "tailoring" the injection fluid potential to maximize the extraction efficiency of the target component within a lower operating cost structure.

The present electrolytic component removal system also adjusts and controls the pH of the carrier fluid to improve efficiency of the extraction process. With an increase of the reducing potential used, typically the greater the pH of the carrier fluid. Conversely, the lower the reducing potential (increased oxidizing potential) used, typically the lower the pH of the carrier fluid.

Further, the present electrolytic component removal system controls the electrochemical state of subterranean strata without the introduction of expensive, complex or externally sourced substances, and reduces overall recovery costs. This allows the fluid or solid mineral components of beneficial and economic value to be extracted and processed at a lower cost than conventional methods, significantly advancing the state-of-the-art.

DETAILED DESCRIPTION OF THE INVENTION

Figure 1:
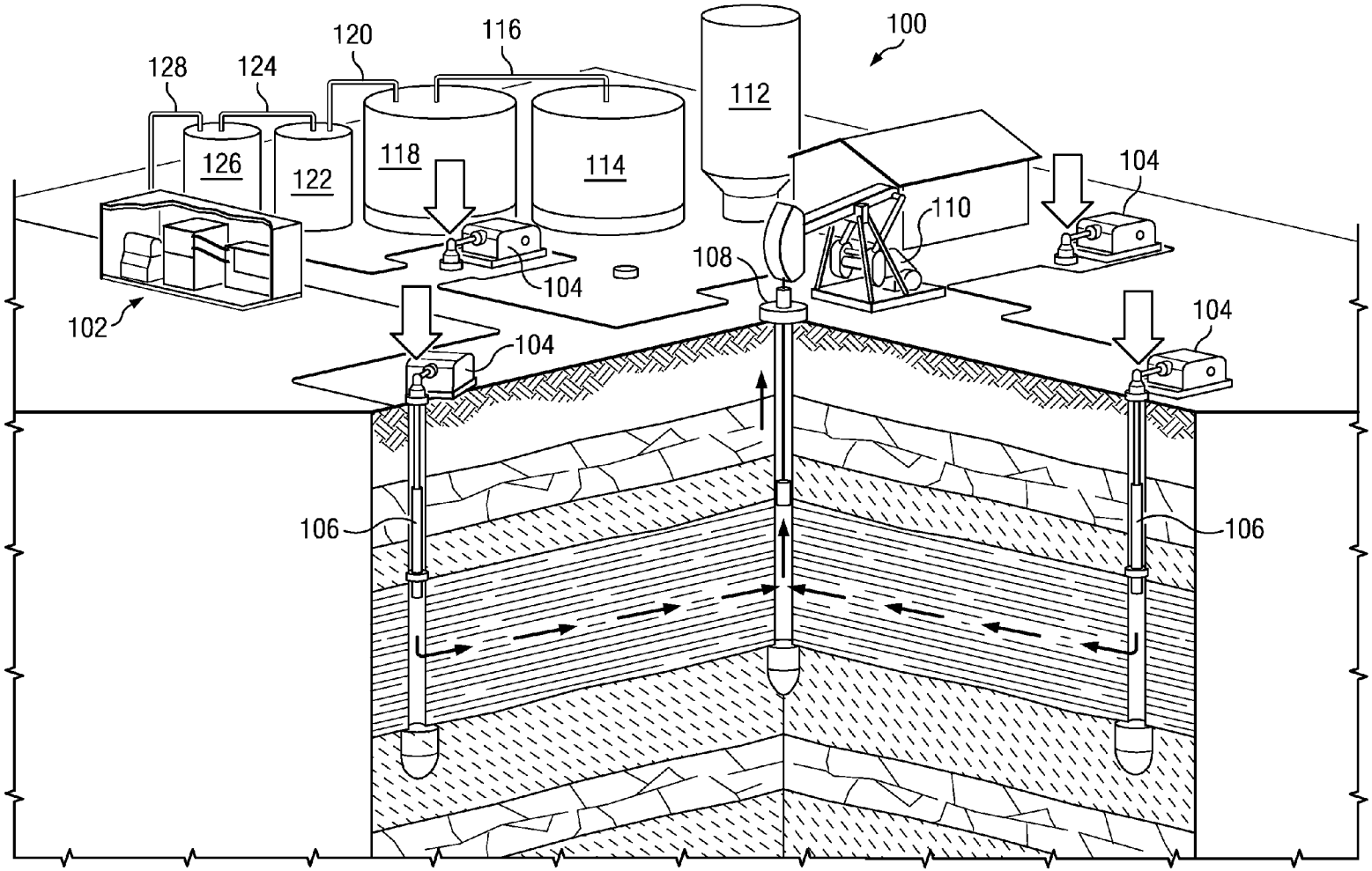
FIG. 1 illustrates a perspective cutaway view of a system for electrolytically removing subsurface components according to one embodiment of the present invention.

Rock-fluid storage mechanisms operate at a different textual scale with fluid saturations related to the pore throat radius and the resulting capillarity. At a much finer spatial scale, where surface active charges begin to dominate, the accommodation of surface charge and the charge of the contiguous fluids influence wettability at the solid-fluid interface. This interface has a width approximately several molecular dimensions where charge between the surface and the fluid is called the Zeta potential ("ζ-potential") charge boundary. The two-phase wettability affects the hydrologic and petrophysical flow properties of the geologic media, rendering the rock either more or less water wet. Derivative petrophysical properties dependent on wettability include capillary pressure, multi-phase relative permeability, and residual or irreducible phase saturations. These petrophysical properties control the saturation range, multi-phase flow mobility, and phase recovery efficiency in which one or more flowing phases may be present in a porous media. These properties control the release, flow, and recovery of oil, gas and other components.

Electrochemical processes operate in porous media and achieve a dynamic equilibrium over geologic time. The rock mineralogy and diagenesis influences the wettability at the solid-fluid interface. The media may be silica based, such as sandstones, or may be carbonate based, composed mostly of calcium carbonate, with both media potentially containing various types of clays and other geologic minerals. Electrochemical adjustments are made by interactions at the solid-liquid interface, having undergone diagenesis processes at the ζ-potential.

The flow of fluids in a porous, multi-phase system will have phase interference as the wetting phase saturation changes. The change of two-phase fluid mobility to that phase saturation is analytically described by relative permeability relationships, and can be used to predict hydrocarbon recovery to an immiscible displacement process. The phase saturations have changed over geologic time and are modified to increase the quantity or recovery efficiency for a hydrocarbon bearing strata. This can be achieved through water flooding or other immiscible or miscible technologies, resulting in changing the rock wettability to augment flow and improve extraction efficiency.

Petrophysical properties influenced by wettability are capillarity and relative permeability. Residual phase saturations control the mobility range during multi-phase flow, while reducing the non-wetting phase residual saturation (e.g., oil) corresponds to increasing recovery of that phase. A capillary pressure versus phase saturation study can be used to characterize the interstitial saturation distribution and the complex relationships between the multi-phase relative permeability as a function of phase saturations. This petrophysical understanding is used to design and improve hydrocarbon recovery from multi-phase fluids trapped in a geologic media.

The fluid flow can be either in a multi-phase system or a single-phase system, such as an aquifer or shallow hydrologic flow system, operating at or below the surface. Aquifer and hydrologic flow theory is well developed and is based on Darcy's Law for a single flowing phase. The flow of fluids in an aquifer is of important economic value, and has been well described theoretically and analytically.

Changes in wettability occur due to deliberate manipulation at the rock-liquid surface with reversible changes in ζ-potential as an electrochemical factor for improved hydrocarbon and mineral recovery. This is a fundamental aspect of the new process and invention described herein.

DEFINITIONS

In order to ensure a proper understanding of the present electrolytic component removal system, the following definitions are provided to clarify the terminology as used herein.

Carrier fluid—water, brine, or other fluid substance that can be treated and introduced to alter the electrochemical state of the liquid-solid interface.

Injection, Production or Well bore—any well, hole, or auger that penetrates the subterranean estate that has been created by an action of man for the production, injection, or other purpose for the recovery or sequestration of components into or out of the subsurface.

Hydraulic fracturing—the process of injecting fluids and proppant materials at high volumetric flow rates and pressures, inducing a fracture in subterranean strata for the purpose of enhancing well productivity or injectivity.

Zeta potential ζ-potential)—the charge that develops at the interface between a solid surface and its liquid medium. This potential, which is measured in millivolts, may arise by any of several mechanisms. Included among these are the dissociation of ionogenic groups in the particle surface and the differential adsorption of solution ions into the surface region.

Oxidation—Reduction potential (Redox potential, or ORP)—a quantitative measure of the energy of oxidation or reduction. Oxidation is equivalent to a net loss of electrons by the substance being oxidized, and reduction is equivalent to a net gain of electrons by the substance being reduced. The oxidation-reduction reaction involves a transfer of electrons. The oxidation-reduction potential may be expressed as the ability to give or receive electrons and is expressed in terms of millivolts (mV) which may be either positive (lack of electrons) or negative (excess of electrons).

Capillarity—describes the saturation distribution in a porous media with smaller pores spaces increasingly occupied by the wetting phase.

Aquifer—water contained in a geologic media.

Reservoir—hydrocarbons contained in a geologic media.

Strata—geologic media that comprises a distinct and genetically related sequence of deposition or formation.

Ionizer—Any device that has the ability to ionize fluids above or below a baseline potential. The configuration of an ionization apparatus may include systems using simple electrolysis with or without a membrane (e.g., ported systems or other configurations), variations in plate configurations, types or materials, or any other embodiment that is able to produce an ionized fluid adequate to generate beneficial results during the extraction/deposition process.

Overall System

FIG. 1 illustrates an embodiment 100 of the electrolytic component recovery system. It should be noted that this is a general application for hydrocarbon recovery and particular equipment and operating parameters will be field specific. Applications for other resource recovery (e.g., uranium, metals etc.) will have significantly different configurations than this example. The electrolytic component recovery system 100 includes a five spot injection and recovery process including four injection pumps 104 each connected to an injection well 106 and a production well 108. The electrolytic component recovery system 100 includes a carrier fluid conditioning subsystem 102 that ionizes the carrier fluid prior to injecting the ionized carrier fluid into the injection wells 106 through the injection pumps 104. The injected carrier fluid then migrates through the strata underground towards the production well 108 where it is recovered and pumped by the production pump 110 to the separation unit 112.

The separation unit 112 separates the carrier fluid from the extracted component, for example, oil. The oil component is then pumped from the separation unit 112 to the product tanks 122 and 126 via pipes 120 and 124. It can later be pumped to a downstream refining operation through pipeline 128 to produce other related products. The separated carrier fluid is then pumped from the separation unit 112 to a storage tank 114 for later processing at the carrier fluid conditioning subsystem 102. Storage tank 118 may store some portion of the output from the carrier fluid conditioning subsystem 102 for later injection into the injection well 106. This configuration allows for increased production while using existing equipment and wells in the field.

Figure 2:
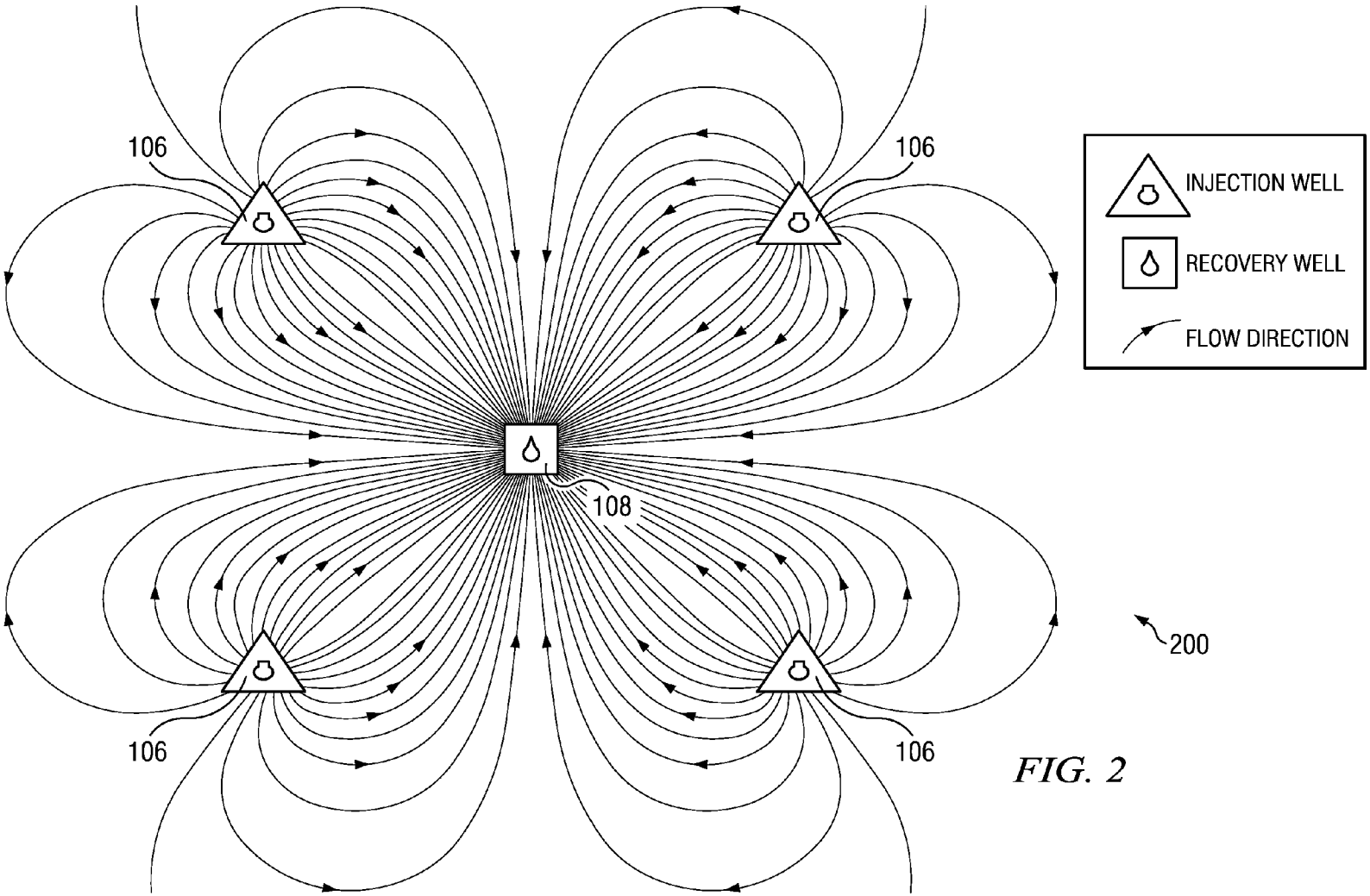
FIG. 2 illustrates a plan view of a typical flood removal flow pattern using standard Darcy Flow principles according to an embodiment of the present invention.

FIG. 2 illustrates an embodiment 200 of a typical flood removal flow pattern (plan view) using standard Darcy Flow principles. This figure shows how hydrocarbons (or other in-situ minerals) would be transported from the injection wells 106 to the production well 108. The carrier fluid is shown flowing in the direction of the arrows between the injection wells 106 and the production well 108.

Figure 3:
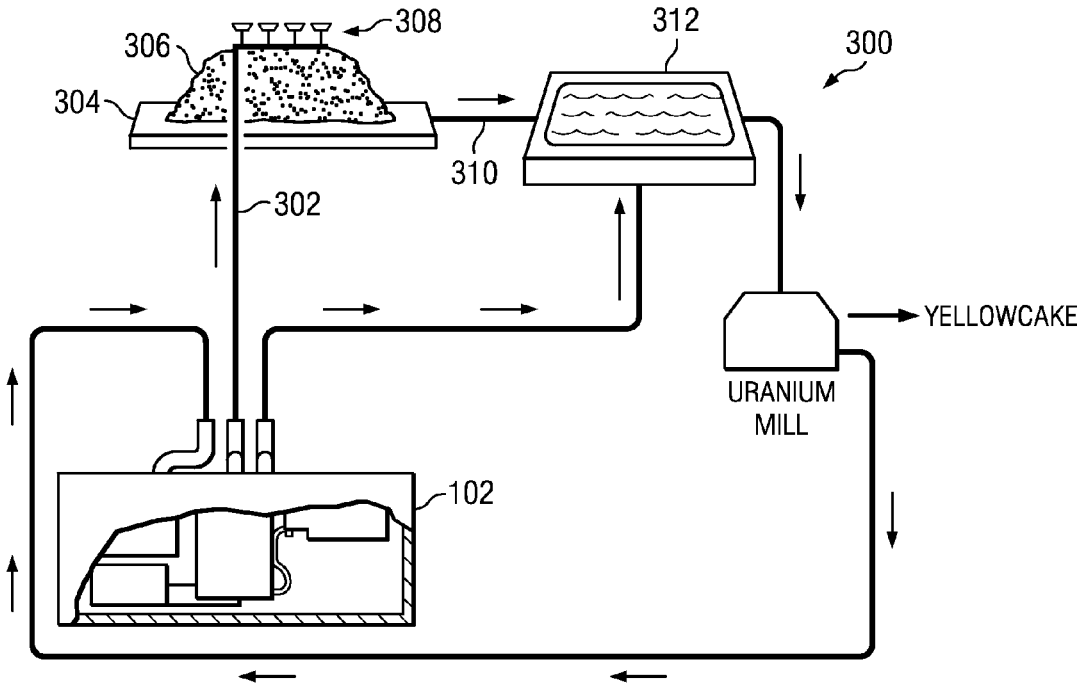
FIG. 3 illustrates a system for electrolytically removing ex-situ components according to one embodiment of the present invention.

FIG. 3 illustrates an embodiment 300 of a system for electrolytically removing ex-situ components, such as uranium. In this embodiment, the electrolytic component recovery system 300 includes a carrier fluid conditioning subsystem 102 and a pipeline 302 for transporting the ionized carrier fluid to a set of sprinklers 308 (or other distribution mechanism). In this embodiment, the carrier fluid conditioning subsystem 102 ionizes the carrier fluid in an oxidizing state. The sprinkers 308 distribute the ionized carrier fluid to the top of an ore deposit 306 in an ex-situ heap leach process. The ionized carrier fluid then flows downward through the ore deposit 306 and leaches the mineral of interest, such as uranium, from the ore deposit 306. The leached mineral is then pumped to a "pregnant pond" 312 where it is further mixed with a carrier fluid in a reducing state that causes the extracted minerals to precipitate for easy collection. The carrier fluids are then recycled through the carrier fluid conditioning subsystem 102 and reused. Other minerals may be extracted or conditioned by this ex-situ process, including but not limited to sulfur in coal, uranium roll-front deposits, disseminated gold deposits, 'Missouri valley'-type ore deposits or other substances where an introduced change in charge potential will result in the recovery of a substance having economic or beneficial utility. In another aspect of the present electrolytic component removal system, the minerals can be solution mined from subsurface deposits by injecting a reducing or oxidizing solution, described further below, and then the minerals are recovered and separated from the carrier fluid.

Separation unit 112 may be a common gravity separation unit or any other known separation unit that is able to physically separate multi-phase solutions and the like. In one embodiment, such separators are commonly used in the petroleum recovery industry. The separation process may be based on the different densities or polarities, such as polar and non-polar properties or characteristics of the multi-phase solution. An ionized solution may be used to assist in the breaking of emulsions in conjunction with the separation process.

Figure 4:
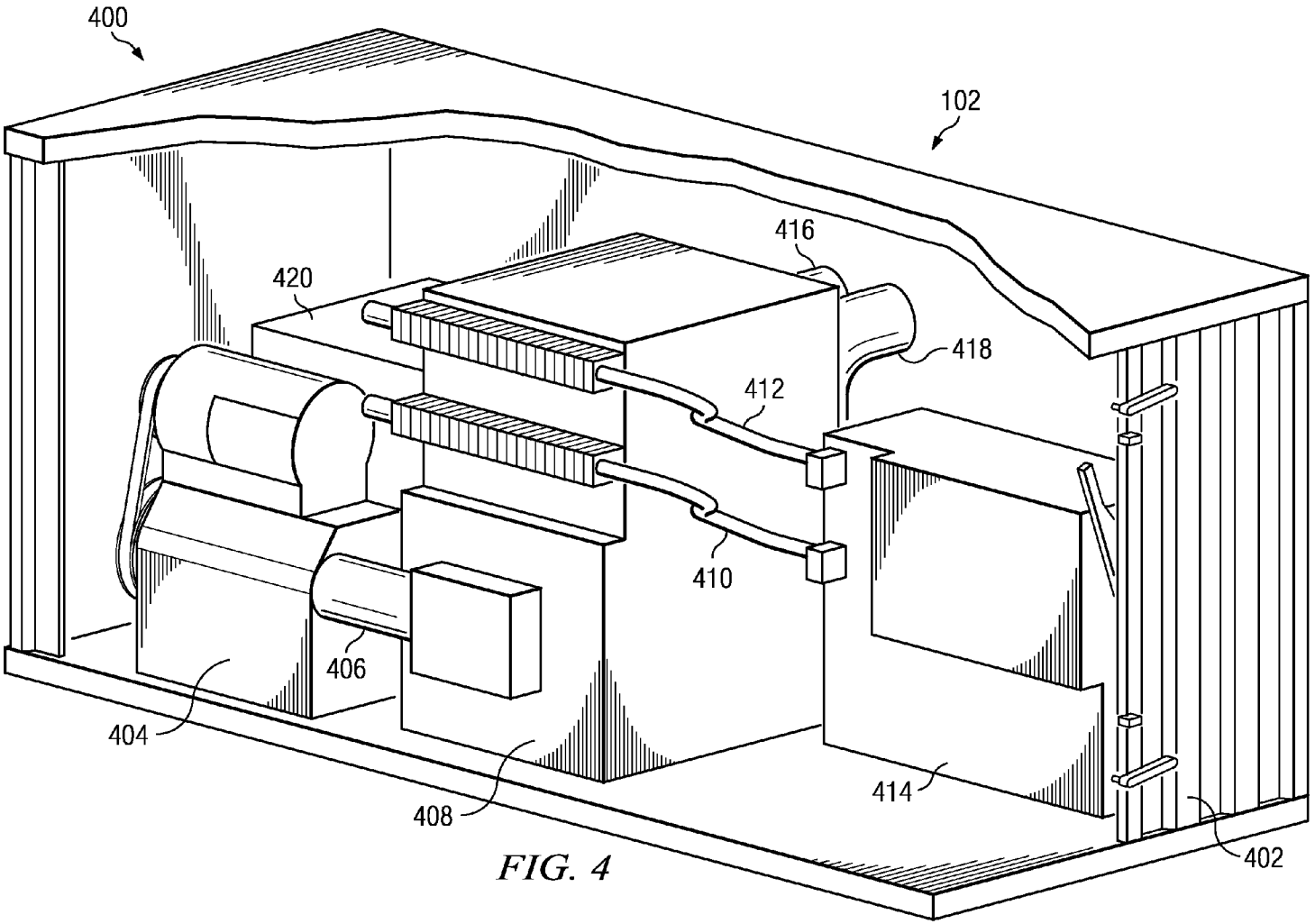
FIG. 4 illustrates a perspective cutaway view of a carrier fluid conditioning subsystem of the electrolytic component removal system of FIG. 1 according to that embodiment of the present invention.

FIG. 4 illustrates an embodiment 400 of a perspective cutaway view of the carrier fluid conditioning subsystem 102 as shown in FIGS. 1 and 3. The carrier fluid conditioning subsystem 102 includes a pumping station 404 that pumps the carrier fluid from the storage tank 114. The carrier fluid is preferably filtered at the filtering unit 420 on its way to the pumping station 404. The filtering unit 420 removes any large pieces of debris from the carrier fluid to prevent damage to the ionization unit 408. Additionally, any adjustments to the carrier fluid can be conducted at this point if necessary. These adjustments may be in the form of mineral addition (or removal) from the carrier fluid. Additionally, materials such as nano-particles, specific polymers or other materials may be added to enhance the ability of the carrier fluid to be ionized or carry a charge, or to enhance the ability to carry the recovered component. The pumping station 404 then pumps the carrier fluid to the ionization unit 408 via pipe 406. The ionization unit 408 includes a reduced carrier fluid outlet 416 and an oxidized carrier fluid outlet 418. The reduced carrier fluid outlet 416, oxidized carrier fluid outlet 418, or both, may then be either plumbed directly to the injection pumps 104 or to the storage tank 118 to be injected later at the injection wells 106. Any number of pumps and storage tanks may be used in the present electrolytic component recovery system 100 and 300 to achieve the desired operation. As described in more detail below, the ionization unit 408 contains a plurality of electrode plates 602 (FIG. 6) that are connected to the power supply, conditioning and network control interface unit 414 via voltage lines 410 and 412. The carrier fluid conditioning subsystem 102 may be housed in a room or a container 402, such as a sea-land container. Electrode plates 602 may be made from any material that fits a designed application, such as titanium, graphite, platinum, stainless steel, iridium and the like.

Figure 5:
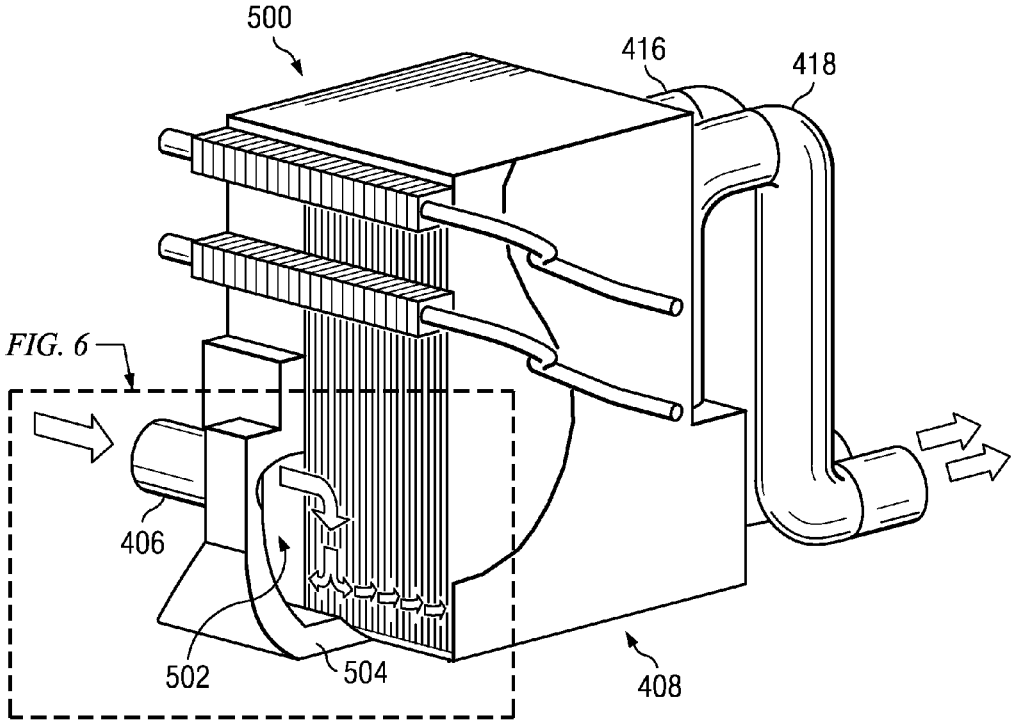
FIG. 5 illustrates a perspective cutaway view of the ionization unit of the carrier fluid conditioning subsystem of FIG. 4 according to an embodiment of the present invention.
Figure 6:
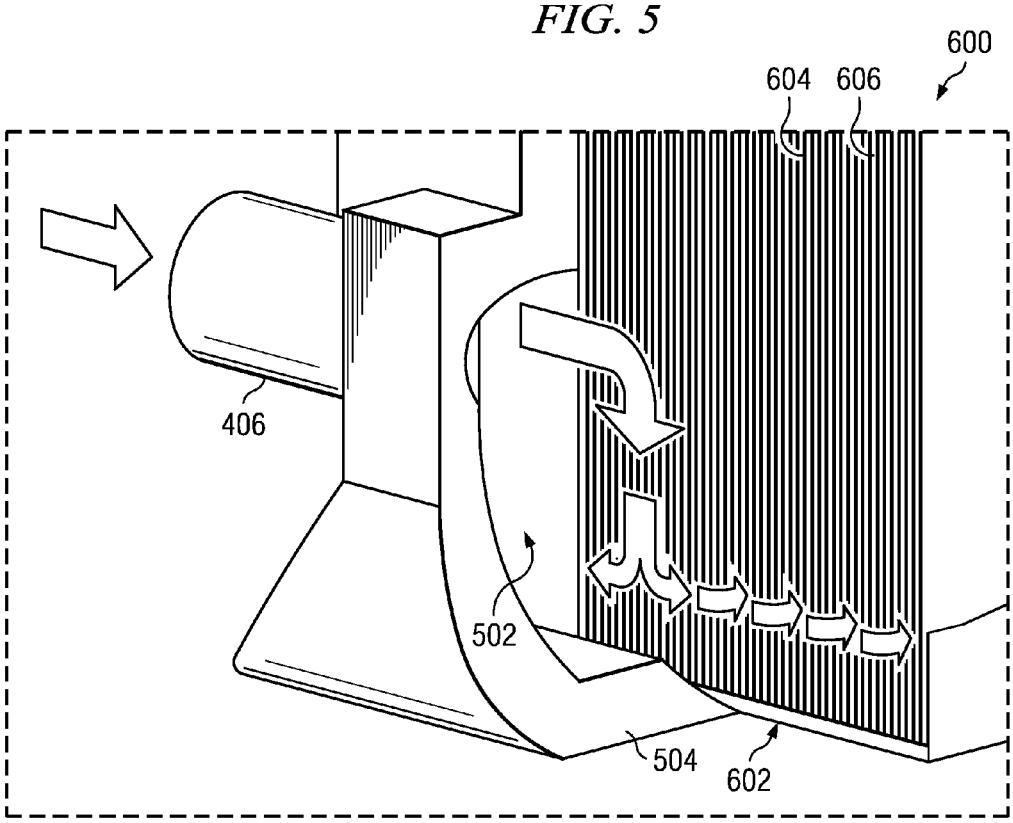
FIG. 6 illustrates an enlarged perspective cutaway view of portion A of the ionization unit of the carrier fluid conditioning subsystem of FIG. 5 according to an embodiment of the present invention.

FIG. 5 illustrates an embodiment 500 of a carrier fluid conditioning subsystem 102 and FIG. 6 illustrates an embodiment 600 of an enlarged view of portion "A" of the carrier fluid conditioning subsystem 102 of FIG. 5. The carrier fluid conditioning subsystem 102 includes an insulated housing 504 that forms an interior compartment 502 where the carrier fluid is distributed from the pipe 406. After flowing through the pumping station 404, the carrier fluid enters the carrier fluid conditioning subsystem 102 where the carrier fluid is ionized and separated into phases. The ionization process uses a plurality or series of pairs of simple electrode plates 602, each pair separated by a permeable membrane 702 (FIG. 7) that is typically made of various chlorofluoro carbons. Although membranes can be made of a wide range of materials including materials as simple as cotton fibers or any other appropriate material. Each pair consists of an anode electrode 604 and a cathode electrode 606. The carrier fluid flows through the electrode plates 602 and is ionized by the charges on the electrode plates 602 and then separated bythe permeable membrane 702.

Figure 7:
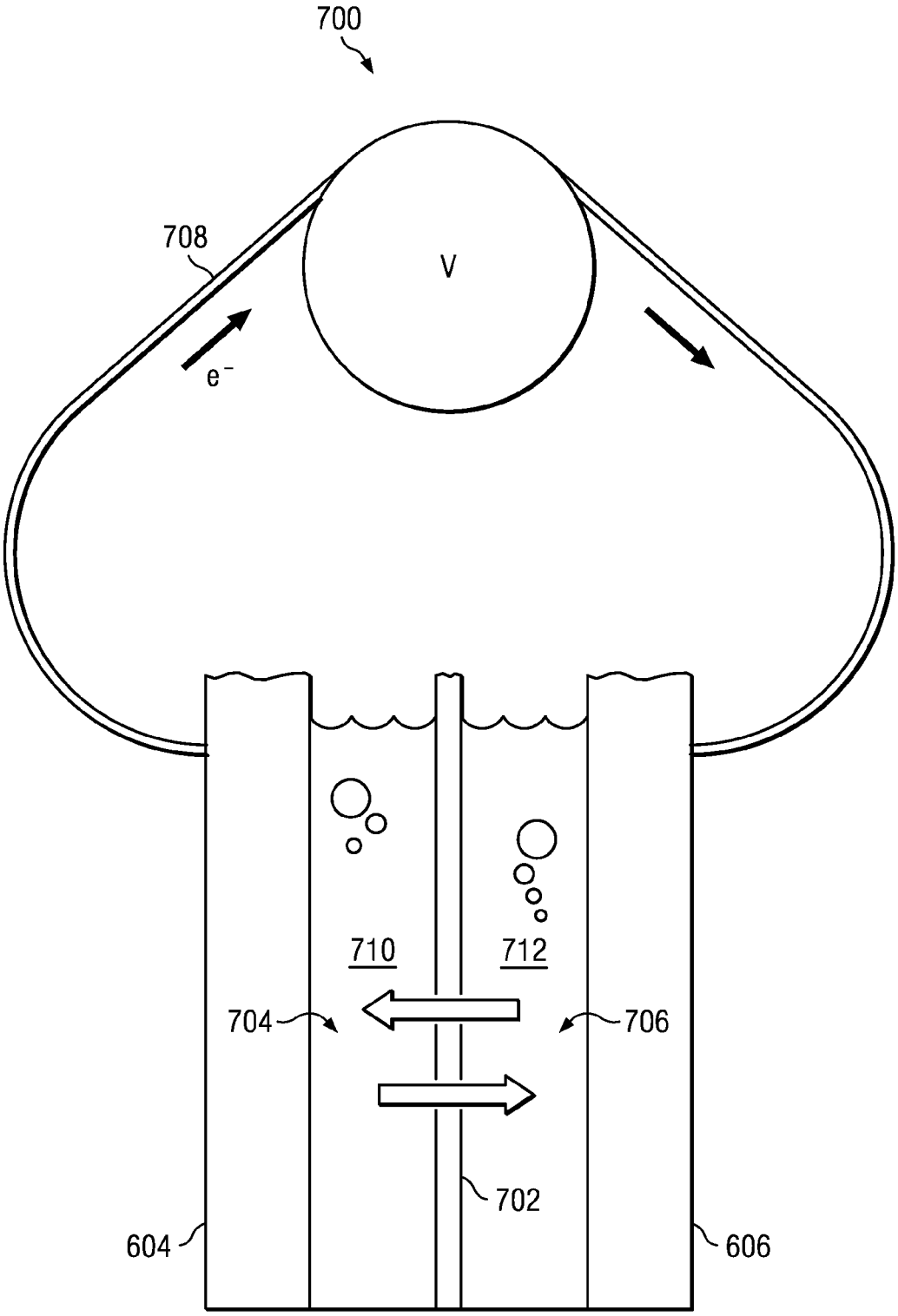
FIG. 7 illustrates two electrode plates and a semi-permeable membrane of an ionization unit of FIGS. 5 and 6 according to an embodiment of the present invention.

FIG. 7 illustrates the electrolytic process that ionizes the carrier fluid of the present electrolytic component recovery systems 100 and 300. The generation of an ionized carrier fluid is produced by ionizing the carrier fluid in the ionization unit 408. As stated above, the ionization unit 408 typically consists of an insulated housing 504 with a plurality or series of pairs of electrode plates 602, such as anode electrode 604 and cathode electrode 606. Although in some designs a conducting material is used for the housing and then doubles as the electrodes. These two charged electrode plates 604 and 606, in this embodiment, are separated by a permeable membrane 702. An electrical potential is applied to the anode electrode 604 and cathode electrode 606 via voltage lines 410 and 412 while a carrier fluid flows through the ionization unit 408. Passageways 704 and 706 are created on each side of the permeable membrane 702 and each electrode plate 604 and 606, respectively. The carrier fluid acts as the conducting medium between the anode electrode 604 and cathode electrode 606. The charge across the two electrode plates 604 and 606 causes anions to be attracted to anode electrode 604 and cations to be attracted to the cathode electrode 606. Thus, the ionized carrier fluid is oxidized at the anode electrode 604 and the ionized carrier fluid is reduced at the cathode electrode 606. The ionized carrier fluid 710 in channel 704 is oxidized and the ionized carrier fluid 712 in channel 706 is reduced. A basic ionizer may also be constructed by using simple containers (like tars) with an electrode in each container and linked with a pipe separated by a membrane. In this "batch" approach a flowing fluid may not be necessary. Some of the variables that control the magnitude of the electrolytic process are the flow rate of the carrier fluid through the insulated housing 504, the charge potential between the two electrode plates 604 and 606, the carrier fluid residence time, and the amperage used to ionize the carrier fluid. Ionization technology is currently in use to produce alkalized water for human consumption and acidic water for disinfectant applications. As is described further below, each application of the present electrolytic component recovery system 100 and 300 may have different magnitudes of the variable for the most efficient use of the ionized carrier fluid. This will be defined by the extraction objectives and the field parameters (fluid TDS, mineral composition, etc.).

The ionized carrier fluid discharged from the insulated housing 504 through all of the channels 706 collectively of all of the pairs of the plurality of electrode plates 602 is separated into one stream that flows out the oxidized carrier fluid outlet 418. All of the channels 708 collectively of all of the pairs of the plurality of electrode plates 602 are separated into another stream that flows out the reduced carrier fluid outlet 416. These two streams have a charge difference related to the dissolved constitutions in the carrier fluid, current density across the anode electrode 604 and cathode electrode 606, residence time in the ionization unit 408, and other secondary factors. The residence time in the presence of a charge allows the carrier fluid and its dissolved solids to disassociate and the anions and cations to pass through the permeable membrane 702, thus separating the dissolved solids. The size, power requirements, and detailed configuration of the ionization unit 408 and permeable membrane 702 (including membrane type) are dictated by the field specific requirements/applications.

In a preferred embodiment of an ionization apparatus, the membranes are typically stationary and placed closer to one plate or the other. This produces differing quantities of the effluent types (reducing or oxidizing), enabling the production of an increased amount of one type of effluent or the other (oxidizing or reducing). With this configuration, the charge on the plates can also be reversed to increase production of one effluent type over the other. This would produce the reversed quantity of produced effluent types. Additionally, the reversal of plate polarity is often used to clean the plates of scale or other materials.

Alternatively, the permeable membrane 702 could potentially be moveable between each pair or plurality of electrode plates 602. Thus, the permeable membrane 702 can be located closer to one electrode than the other electrode to create a larger volume of one species of ionized carrier fluid. For example, the permeable membrane 702 could be located closer to the anode electrode 604, thereby creating a greater volume of ionized carrier fluid 712 to be created. The membrane can be moved closer to one electrode to produce one species of ionized carrier fluid, such as ionized carrier fluid 710, and then later moved closer to the other electrode to produce another species of ionized carrier fluid, such as ionized carrier fluid 712.

Other configurations of an ionization apparatus could include systems using simple electrolysis with or without a membrane (e.g., ported systems or other configurations), variations in plate materials/configurations, such as tubes, meshes or blades in place of standard electrode plates, or any other embodiment that is able to produce an ionized fluid adequate to generate beneficial results during the extraction/deposition process. In one embodiment, the ionization unit 408 comprises one or more pairs of electrode plates 602 without a membrane interspersed between each of the one or more pairs of electrodes. In this embodiment, the housing 504 contains these electrode plates 602 and has an outlet located proximal to each electrode of each of the pairs of electrode plates 602 to remove the ionized carrier fluid prior to the ions being substantially deposited onto the electrodes.

The ionization of a carrier fluid that is saline (or other fluid with appropriate Total Dissolved Solids or TDS) changes the fluid ionic composition on both sides of the membrane 702. For example, as the carrier fluid passes through the ionization unit 408, it undergoes a partial disassociation of both the water (HOH) component and salt NaCl) component of the carrier fluid, with ions migrating through the permeable membrane 702 to the opposite charged side where re-association will occur. For example, on one side of the membrane, sodium ions ($Na^+$) and hydroxyl ions ($OH^-$) will re-associate to form sodium hydroxide, NaOR commonly known as the "ankle" side. On the opposite charged side, hydrogen ions ($H^+$) will re-associate with chlorine ($Cl^-$) and form hydrochloric acid, or more typically hypochlorous acid, and is often known as the "acidic" or astringent side. Other compounds or combinations of compounds are used to attain the same goals using this approach. Most types of ionization units 408 will be able to produce this effect, although ionization units 408 that have chemical tolerant plates/membranes, possess easy to adjust controls, and are energy efficient are preferable.

The ionized carrier fluid, whether reduced or oxidized, is then transferred to the injection pumps 104 and injection wells 106 and pumped into the hydrocarbon producing strata or ore deposit 306. The oxidizing ionized carrier fluid may be used for removing algal mats, sterilizing the strata formation, enhancing the porosity of sub-surface formations, or establishing a base electrochemical potential prior to releasing the hydrocarbons, among other applications. The alkaline ionizing carrier fluid can be used, with or without the oxidizing precursor, to release the hydrocarbons for recovery or reducing the corrosion in piping/equipment and the like. As noted above, the storage tank 118 can be used to store one or the other of the ionized carrier fluid while the other is pumped into the injection pumps 104 and injection wells 106. For example, the oxidizing ionized carrier fluid can be stored and used for breaking emulsions in separator tanks, or for pretreating the feed water as a biocide. In another application, the oxidized carrier fluid can be used as a microbe or "bug killer" in subsurface deposits. Subsurface microbes or "bugs" have a tendency to sour crude oil reservoirs over time, but by injecting the oxidized carrier fluid into the injection wells 106 the microbes are eliminated, rather than being continually introduced through the injection/recovery process. Further, the oxidized carrier fluid can be used to kill algae in equipment, such as piping, wells, and the like. In addition, the oxidized carrier may be used as a biocide to kill bacteria in equipment, such as reservoirs, pipelines, wells, and the like. Such actions would reduce the "souring" of the crude oil from injected microbes produced by the current water flooding process. It may also be used to alter the subsurface porosity of formations. Further, due to the reversibility of the ionized carrier fluid, it may be used to create a curtain effect to arrest unwanted component movement and/or provide environmental protection of groundwater. Further, the ankle fluid can be used for corrosion control in piping or other equipment and components. The ionized fluid can be used to kill the microbes that also cause corrosion, like sulfur eating bacteria in piping and equipment, to prevent corrosion of this equipment. The carrier fluid may also be augmented with other "make-up" water as needed.

Figure 8:
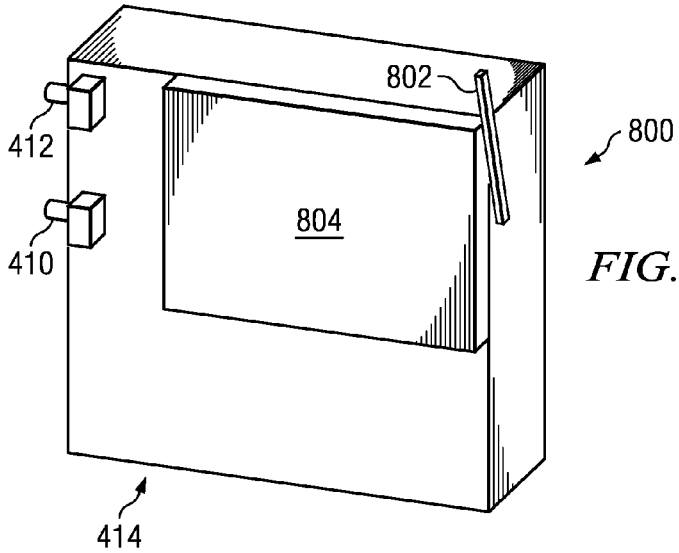
FIG. 8 illustrates a perspective view of a power supply conditioning and networked control interface unit of the carrier fluid conditioning subsystem of FIG. 4 according to an embodiment of the present invention.
Figure 9:
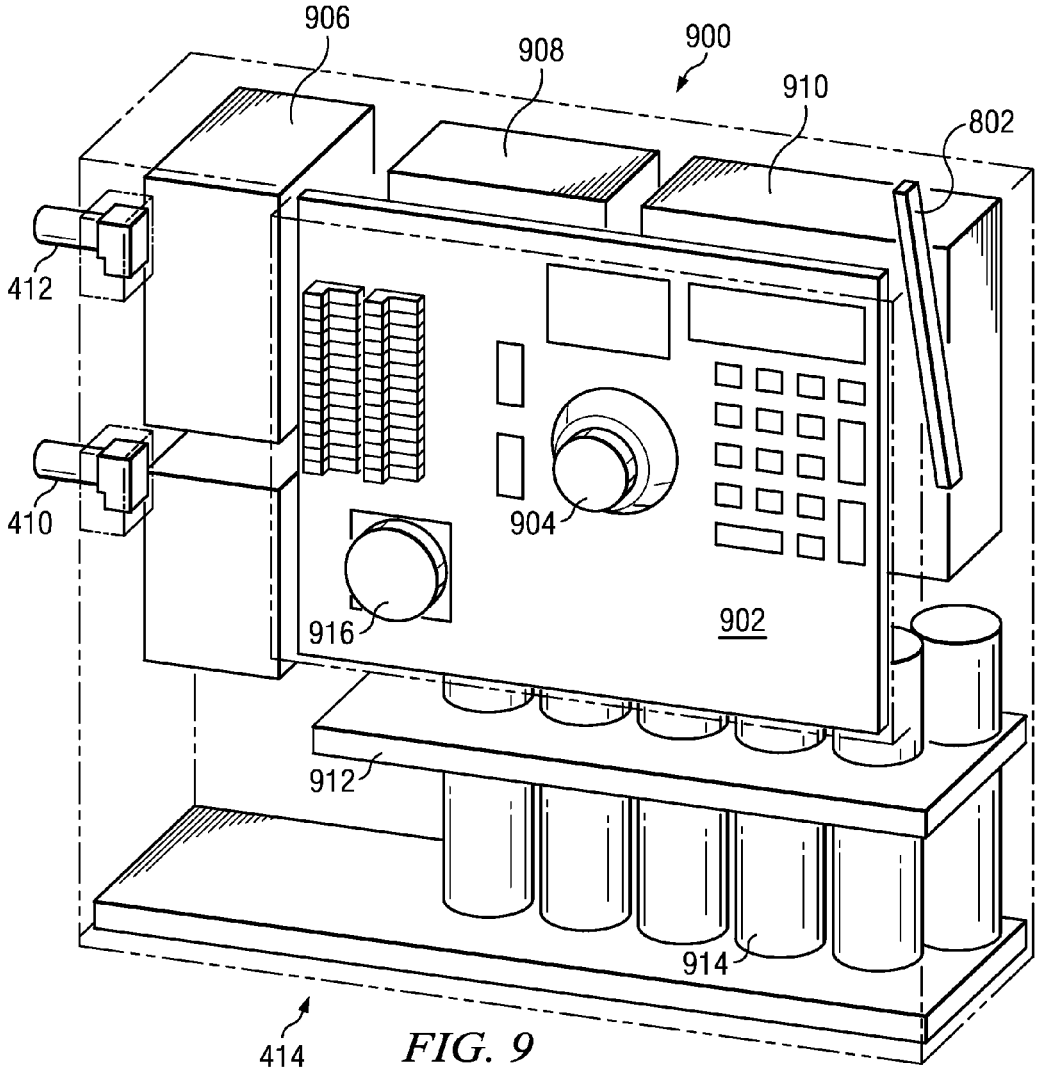
FIG. 9 illustrates an exposed perspective view of the power supply conditioning and networked control interface unit of the carrier fluid conditioning subsystem of FIG. 4 according to an embodiment of the present invention.

FIG. 8 illustrates a power supply conditioning and network control interface unit 414 of the carrier fluid conditioning subsystem 102. The voltage lines 410 and 412 are shown protruding out of the side of the power supply conditioning and network control interface unit 414. Also, in one aspect, the power supply conditioning and network control interface unit 414 may include a control access door 804 for protecting the controls from the elements and the environment. A main disconnect 802 is also shown for quickly disconnecting the main power supply from the power supply conditioning and network control interface unit 414. FIG. 9 illustrates the power supply conditioning and network control interface unit 414, with the internal elements exposed for clarity. In particular, the power supply conditioning and network control interface unit 414 includes a main control interface 906 for supplying power to the voltage lines 410 and 412. In addition, the power supply conditioning and network control interface unit 414 preferably but not necessarily includes a network server 908 and a central processing unit 910 for further controlling the voltage supply to the voltage lines 410 and 412. Further, the power supply conditioning and network control interface unit 414 preferably includes a voltage rectification and conditioning element 914 for rectifying the voltage prior to its output through the voltage lines 410 and 412. Also, the power supply conditioning and network control interface unit 414 includes an integrated carrier fluid pump frequency drive controller 912 for controlling the pumping station 404. The power supply conditioning and network control interface unit 414 maintains the necessary settings for the ionized carrier fluid to maximize its effectiveness. A control panel 902 includes controls that may be manually operated or operated by a computing system located within the power supply conditioning and network control interface unit 414 or remotely via a network (not shown). The control panel 902 consists of a power control knob 904 and a polarity reversal switch 916. The power control knob 904 allows for adjustments to the voltage applied to the plurality of electrode plates 602, and thus controls the redox potential of the effluent carrier fluid. This control is known as the "dial-a-yield", and allows adjustment to best suit the potential that is needed to most efficiently extract the components of interest. The polarity reversal switch 916 provides for cleaning of the plurality of electrode plates 602 by reversing the polarity, and to maximize the type of carrier fluid produced for a given application. In another aspect of the present electrolytic component removal system, the polarity may be switched or reversed to produce a different species of ionized carrier fluid in a particular channel 706 and 708.

Both ionized materials will also have a significant "shift" in their respective redox potential from the initial state of the carrier fluid as the carrier fluid is adjusted to a different ionic state. The alkaline side will have a dramatic increase in excess electrons and become a powerful reducing agent. The opposite is true for the acidic side, which is deficient in electrons and is thus a powerful oxidizer. These shifts in redox potential can be well in excess of + or −5000 mV as measured by eH. This limit can be as high as where the carrier fluid completely disassociates and will not carry any additional charge, or is no longer useful to the process. Alternatively, any measurable change in redox may be sufficient to produce desirable results. This measurement can be made by a simple pH/eH meter or more sophisticated data logging can be achieved by using a continuous flow through design, such as with inline pH/eH analyzers. Combinations of changing redox, pH, and the addition of select ions to modify the ionic state of the carrier fluid prior to injection into injection wells 106 allows for a controlled and selective extraction of economically valuable minerals and fluids.

The charge introduced by the carrier fluid creates a transient into the existing electrochemical potential field in a porous media. This transient is sustained by the continuous injection of electrons in the carrier fluid. Direct grounding (dissipation of electrons) is accomplished with a solid media such as rock, or grounding with the liquid media contained within the rock pore space. Thus, changes in the electrical state of the host rock act as ground for excess electrons.

The change in redox potential dissipates by various physical responses in the porous media. One such response is at the solid-liquid interface, where electron shifts are controlled by the ζ-potential. The ζ-potential acts from the solid to the liquid interface with a width on the order of a few molecular dimensions from the interface, and controls the release or retention of a liquid or solid bound to the solid-liquid interface by essentially an electrostatic charge. In a porous media, this phenomenon is complicated by complex pore geometry.

A multi-phase liquid in contact with a porous media, the ζ-potential at the solid-liquid interface has a substantial effect on the preferred rock-water wettability state. The ζ-potential is the interface where charge differences between the solid and liquid are accommodated.

Rock wettability affects petrophysical properties such as capillary pressure, residual phase saturations, and multi-phase relative permeability. These flow attributes are fundamental reservoir engineering properties characterizing and describing the production and extraction of hydrocarbons from the earth's crust. The threshold activation energy required to shift the wettability state depends on the composition of the carrier fluids and subsurface media, the fluid-solid interaction, charge potential, and the fluid-fluid interaction for binary mixtures. Liquid and solid mineral resources can be recovered and processed by controlling and directing shifts in the electrochemical potential at the solid-liquid interface.

Electrochemical Potentials

Figure 10:
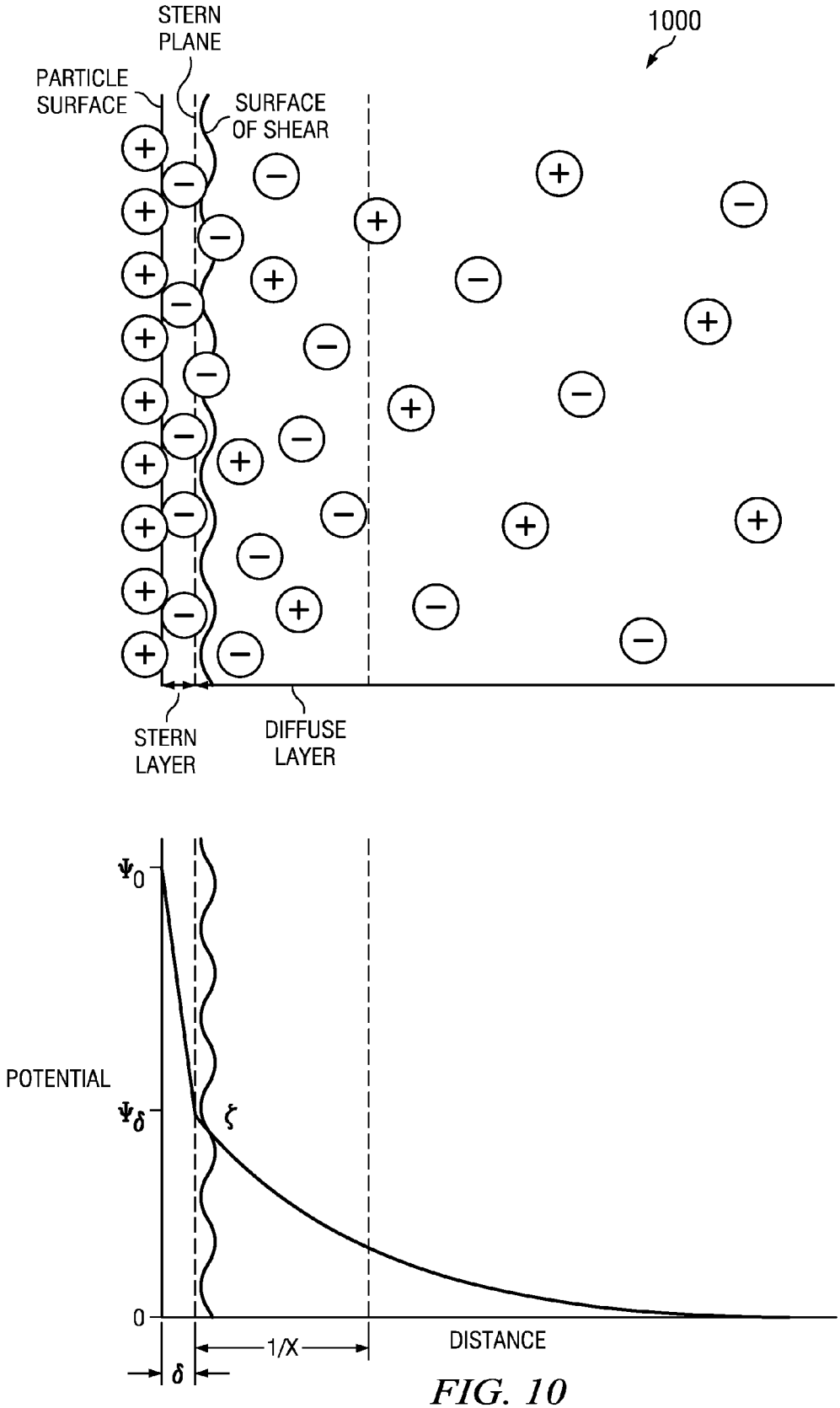
FIG. 10 illustrates the Zeta potential at a solid-liquid interface and a charge distribution of a porous media according to an embodiment of the present invention.

FIG. 10 illustrates a ζ-potential at a solid-liquid interface and the hypothetical charge distribution. The charged layers at the solid-liquid interface behave as two parallel surfaces of opposite electrical charge separated by a distance of molecular dimensions. A layer of one charge on the solid particle surface and a layer of opposite charge in the layer of fluid directly adjacent to the solid surface (Stem Layer) has a potential difference called the ζ-potential. The outer region where a balance of electrostatic forces and random thermal motion determines the ion distribution is known as the diffuse layer. The ζ-potential acts on the solid-liquid interface at the fine-scale mineralogical domain, satisfying electrochemical potentials that increase the water wettability of a porous media. If electrical forces displace or change the charge, fluid can either be released or entrapped from the solid-liquid interface. In an oleic-water system, a reducing environment (addition of electrons) increases water wettability, reducing the ζ-potential at the rock-liquid interface, releasing trapped hydrocarbons, and reducing the residual saturation of oil in a porous media. The present electrolytic component removal system acts upon the charge balance without the introduction of external chemicals or extraneous substances. By introducing an ionized carrier fluid to the solid-liquid interface, the charge on the carrier fluid disrupts the solid-liquid interface, thus allowing the mineral, such as oil, to not be attracted to (be repelled by) the charge of the particle surface. In addition, in one embodiment, the carrier fluid is comprised of water, which, due to its surface tension with the solid surface, displaces the mineral, such as oil, from the individual capillaries comprising the subsurface reservoir.

Figure 11:
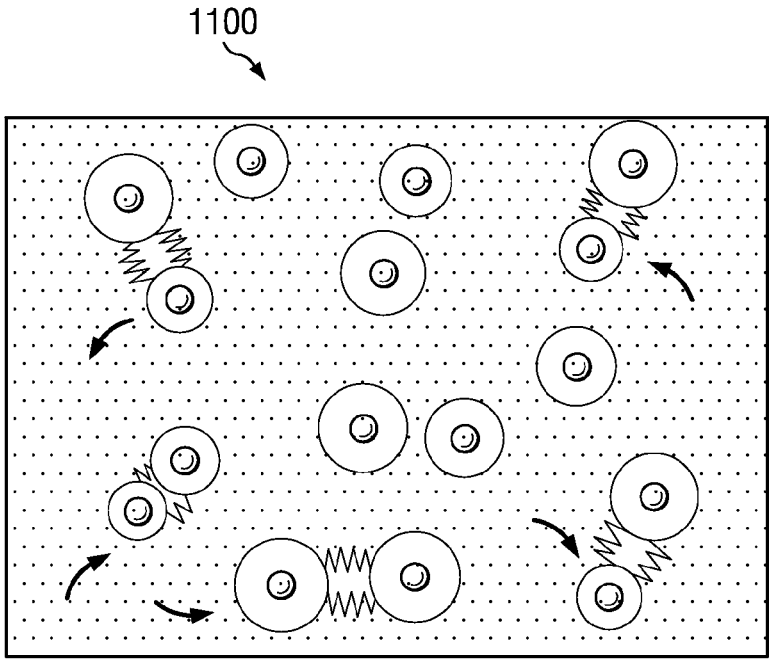
FIG. 11 illustrates dispersed particles as the Zeta potential increases.
Figure 12:
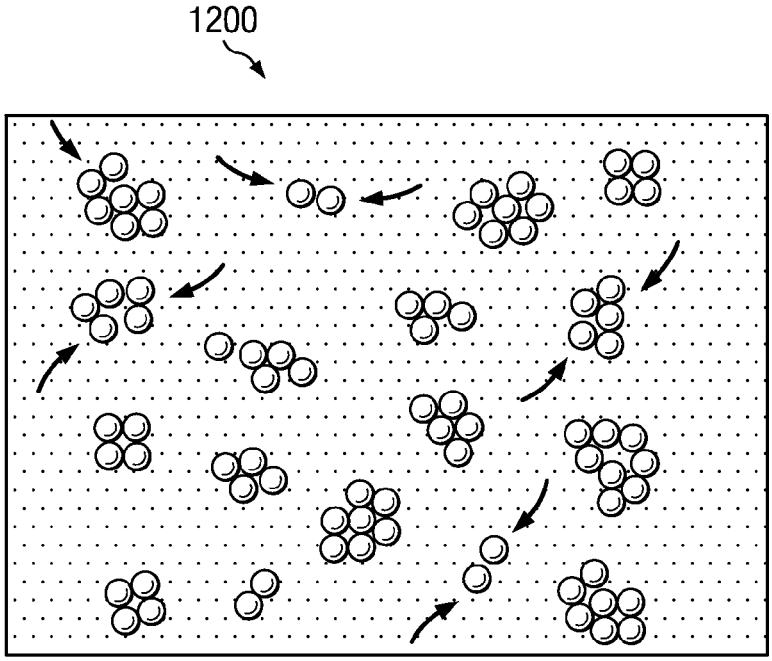
FIG. 12 illustrates aggregate particles as the Zeta potential decreases.

Particles dispersed in a solution are electrically charged due to their ionic characteristics and dipolar attributes. The dispersed particles are surrounded by oppositely charged ions and an outer diffuse layer, with the whole area being electrically neutral (the difference being the ζ-potential). As the potential between the particles and the fluid approaches neutrality, the particles have a tendency to aggregate. FIG. 11 illustrates a diagram 1100 of particles that are dispersed due to a higher ζ-potential, and FIG. 12 illustrates a diagram 1200 of particles that are aggregated due to ζ-potential approaching zero. Generally, oil is in an aggregated state in a subsurface reservoir, but when an ionized carrier fluid is introduced into the reservoir, the oil begins to become dispersed, thus making it easier to recover with an immiscible process, such as that described herein. The dispersed particles are surrounded by oppositely charged ions and an outer diffuse layer, with the whole area being electrically neutral (the difference being the ζ-potential). As the potential between the particles and the fluid approaches neutrality, the particles have a tendency to aggregate.

Van der Wals forces act at the pore scale as a hydrocarbon capture and storage mechanism. The solid-liquid interactions occur at smaller and smaller scales until they approach the region where Van der Wals attractive forces are a hydrocarbon storage mechanism. The introduction of excess electrons will release the oleic phase from a solid-liquid interface, with more of the internal pore structure becoming water wet. This is accomplished by lowering the charge potential to make it more negative (−mV) to increase the water wettability.

The change in charge can be reversibly controlled by the introduction of an oppositely charged carrier fluid, thus directly changing the rock wettability state and the ζ-potential. The charge can be reversed by introducing an oppositely charged carrier fluid into the system. Further, to the Experimental Data below, when completing the experimental cycle and re-saturating the test column, additional oil is retained within the test column when an oppositely charged carrier fluid is introduced. A "memory effect" is also noted within the experimental data as the column retains a portion of the applied charge even after a neutral flush is conducted and a fluid of opposite charge is often necessary to return the column to charge neutral. When the oil in the test column is displaced by the reducing water, the residual oil saturation to the water phase increases. Summarizing, the charge can be reversed by the introduction of an oppositely charged fluid having either an excess or deficit of electrons. Since the ionization process produces both types of fluid, either is available to customize the extraction process to achieve maximum efficiency.

The theoretical and experimental verification of solid-liquid interfaces demonstrates that excess electrons, whether introduced externally by chemicals or by on site generation, changes the ζ-potential as excess electrons are dissipated, releasing oil from the complex pore geometry where capillarity and pore surface by making the system more water wet. The increase in water wettability reduction in the residual hydrocarbon phase saturation mobilizes previously immobile hydrocarbons for displacement by standard immiscible displacement technology.

The direct introduction of electrons uses the rock surface as a grounding media for the host rock This process acting directly within the complex pore scale geometry and tortuosity, adds electrons to the reservoir and releases oil trapped in very fine-scale pore surfaces by the change in ζ-potential.

The hydraulic introduction of a fluid into a permeable and porous media will result in the establishment of a flow field from a region of higher to lower pressure, and the flow of fluids in response to a pressure gradient, described by Darcy's Law for single-phase, one-dimensional radial flow is:

$$\frac{1}{r}\frac{\partial}{r}\left(\frac{k\rho}{\mu}r\frac{\partial\rho}{\partial r}\right)=\phi c\rho\frac{\partial\rho}{\partial p} \qquad \text{I}$$

The absolute permeability, k, will be reduced in a multi-phase system by the relative permeability to each phase, which can be parametrically constructed using dimensionless saturation described as:

$$\bar{S} = \frac{(1 - S_w)}{(1 - S_{oir} - S_{wir})} \quad \text{II}$$

where the dimensionless saturation is a function of the flowing phases, o, and the irreducible saturations of phases wand o, such that;

$$\bar{S} = f(S_w, S_{oir}, S_{wir}). \quad \text{III}$$

The relative permeability of the two phases, w and o, are then expressed as $$k_{rw} = \left[\frac{(1 - S_w)}{(1 - S_{oir} - S_{wir})}\right]^{n_w} \quad \text{IV}$$

for the water phase and $$k_{ro} = \left[\frac{(1 - S_w - S_{oir})}{(1 - S_{oir} - S_{wir})}\right]^{n_w} \quad \text{V}$$

for the oil phase. The exponent $n_w$ and $n_o$ provide curvature to the curves, an exponent of unity describing a straight line relative permeability. The fractional flow of water in a hydrocarbon reservoir by fractional flow theory for two immiscible fluids, where $f_w$ is the fractional flow of water, $$f_w = \frac{1}{\left(1 + \frac{\mu_w}{k_{rw}} \cdot \frac{k_{ro}}{\mu_o}\right)} \quad \text{VI}$$

in a horizontal flow, or more generally as found in nature, for inclined flow, $$f_w = \frac{1 - \frac{k k_{ro} A}{q_t \mu_o} \cdot \frac{\Delta\rho \sin\theta}{1.0133(10^6)}}{\left(1 + \frac{\mu_w}{k_{rw}} \cdot \frac{k_{ro}}{\mu_o}\right)}. \quad \text{VII}$$

The fractional flow of water, $f_w$ is a function of average end-point residual phase water saturation, which changes as the water saturation front expands radially away from the water injection source. Thus, the fractional flow of water is functionally dependent on, $$f_w = f(k_r, \mu, 6, S_{wir}, S_{oir}, \ldots)$$

The incremental oil recovery due to immiscible displacement occurs at the saturation shock front. After water breakthrough to a producing well, the average water saturation behind the shock front is given by:

$$\ddot{S}_w = S_{we} + (1 - f_{we}) \frac{1}{\left.\frac{d f_w}{d S_w} g\right|_{S_w}} \quad \text{VIII}$$

The incremental oil recovery is, $$N_{pD} = S - S_{wc} = (S_{we} - S_{wc}) + (1 - f_e) W_{id} PV, \quad \text{IX}$$

Thus, stated functionally in a general sense, the incremental oil recovery is, $$N_{pd} = f(\bar{S}, \mu, k_{ro}, k_{rw}, \theta, +, \ldots) \quad \text{X}$$

The displacement process operates with the mobile saturation range operating between $S_{wir}$ and $S_{oir}$ at which both phases are flowing.

Thus, formally stated, a reduction in the $S_{oir}$ will release additional trapped hydrocarbon from the porous media, rendering it available for flow and transport to a production well by the introduced hydraulic flow field. An improved immiscible displacement process is achieved by lowering the irreducible oil saturation by direct action of chemical or other methods. The introduction of excess electrons by an immiscible carrier fluid acts directly on the ζ-potential to change the preferential phase wettability on the pore surface to a more water wet state. The oil is expelled by an increase in water wettability due to the changes in charge potential at the solid-liquid interface, and a reduction in the interfacial tension between the water and hydrocarbon phases.

The capillary pressure in a porous media is, $$p_c = \gamma_{wo}\left(\frac{1}{r} + \frac{1}{r'}\right) \quad \text{XI}$$

Where $\gamma_{wo}$ is the specific free energy of the interface between the wand o phases and the characteristic principal radii of curvature for the interface is r and the specific free energy, r'.

The interfacial tension between two immiscible phases is given as, $$\cos\theta = \frac{\gamma_{sw} - \gamma_{so}}{\gamma_{wo}} \quad \text{XII}$$

Figure 13A:
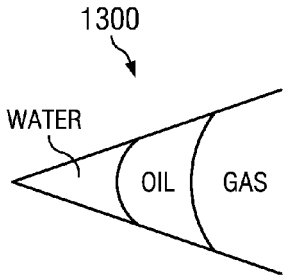
FIGS. 13*a*-13*c* illustrate a trapping mechanism for various different wettability states and their impact on the contact angle.
Figure 13B:
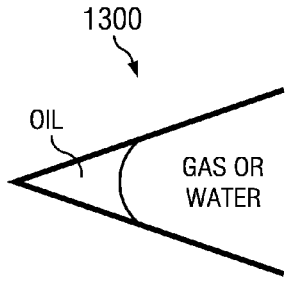
Figure 13C:
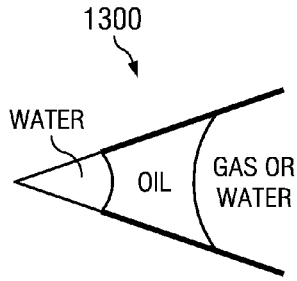

The cos 6 is the contact angle between the w and o phases for the solid substrate. A porous media can consist of general rock types such as quartz, carbonates, and shales. A depiction of the various wettability types and inferred contact angles can be seen in FIGS. 13*a*-13*c*. As an ionized carrier fluid is injected into the strata subsurface, the capillary dynamics shift from an oil wet system FIG. 13*b*) to a more water wet system (FIG. 13*a*). This illustrates a trapping mechanism for different wettability states and the impact on the contact angle[6]. The three figures illustrate fluid trapping in a corner; with FIG. 13*a* showing a water wet system. Water occupies the corner for some distance, with oil or gas occupying the rest of the pore in a water wet system. Referring to FIG. 13*b*, in an oil wet system, oil occupies the corner and water or gas fill the remainder of the pore. FIG. 13*b* is a depiction of how oil or petroleum is stored in the subsurface strata. Referring to FIG. 13*c*, a mixed-wettability system has water occupying the corner with oil adjacent to it; however, the contact angle between the two-phases has changed to establish equilibrium.

The capillary trapping of two immiscible phases is expressed in functional form as, $$p_c = f(\gamma_{wo}, \cos 6, r, r', \text{rock type}, \ldots). \quad \text{XIII}$$

The rate and recovery of oil by a decrease in the residual oil saturation is dependent on those factors acting directly on the rock wettability, as described by the ζ-potential. The wetting phase shift is determined by the potential electrochemical gradient, with a shift to more negative (−mV), increasing to a more water wet state. A shift to a less negative (+mV) state results in increased attraction of a hydrocarbon to a solid-liquid interface and a corresponding increase in residual oil saturation and oil wettability.

The electrochemical potential for a dilute solution of binary electrolytes is presented as, $$E = \frac{RT}{ZF}\left(\frac{v-u}{v+u}\right)\ln\frac{R_1}{R_2} \quad \text{XIV}$$

Where v and u are the anion and cation mobility, respectively, Z is the valance of the ions, and F is in faradays. The constants include R and T and the gas constant with absolute temperature. $R_1$ and $R_2$ are defined as the resistivity of the two fluids.

Electroosmosis transport of a fluid through a porous plate occurs when a potential difference is maintained between two electrodes. The diffuse charged layers at the solid-liquid interface can be idealized as two parallel plates at a distance, d, apart. The charge potential per unit area, e, on a plate and the dielectric constant of the media, $D_{\in 0}$, so that ζ-potential is, $$\zeta = \frac{e \cdot d}{D_{\varepsilon 0}}, \text{ in volts.} \quad \text{XV}$$

When an electrical potential is applied in a porous media, a gradient E exists within the liquid-filled pore space. As electrical forces dissipate the charge, the wetting fluid at the solid-liquid interface is physically dragged by flow potential along the charged interface, altering the wettability characteristics at the solid-liquid interface. This potential can either increase or decrease the preferred wettability at the interface, depending on the magnitude and direction of the change in charge.

Combining the various terms involved and expressed in functional form, the incremental change in residual oil saturation is, $$\Delta S_{oir} = f(\zeta, E, p_c, \cos 6, \ldots). \quad \text{XVI}$$

A change in redox potential or electrochemical potential at the solid-liquid interface acts directly on wettability. Thus, hydrocarbons held within strata are recovered by the direct addition of electrons (reducing condition) via a carrier fluid altering the rock wettability to a more water wet system. A shifting in the rock wettability to a more water wet state results in the direct expulsion of hydrocarbons at the solid interface. The released hydrocarbons are recoverable from the Darcy Flow field and standard immiscible recovery technologies.

It is a more negative shift in the ζ-potential that releases hydrocarbons for improved recovery efficiency. An increase in the redox potential of the carrier fluid increases rock-water wettability. The magnitude of the electrochemical shift required by the carrier fluid depends on the geologic, mechanical, and petrophysical properties of the porous media.

The opposite is also true. Where a carrier fluid having a lack of electrons (oxidizing condition) is introduced, the wettability will shift to an increasing oil-wet state. Reversibly controlling the wettability of a porous media allows for improved control of extraction and deposition processes.

Thus, to summarize mathematically in functional form, the primary factors in the incremental recovery of hydrocarbons due to the application of an ionized carrier fluid are;

$$\Delta \text{oil} = f(\zeta, E, p_c, \cos 6, D_{\in 0}, \gamma_{wo}, \ldots). \quad \text{XVII}$$

These are a combination of intrinsic rock properties and the altered petrophysical properties. Additional terms and variables are incorporated by reference from the petroleum literature.

The electrochemical, engineering, and analytical basis for using an ionized carrier fluid to recover additional hydrocarbons from a porous media have been described. This invention's application is not limited to hydrocarbon recovery, but also applies to other liquids or solid minerals that are found in the subsurface. The use of ionized carrier fluids will recover additional liquid or solid minerals of commercial value through a controlled and engineered shift in the redox potential at the solid-liquid interface in either direction, depending on the fluid or solid mineral to be extracted.

This present electrolytic component removal system application is not limited solely to hydrocarbon recovery, but applies also to other liquid or solid minerals found in a geologic media, where the use of ionized carrier fluids will recover additional liquid or solid minerals of commercial or other beneficial value through a controlled and engineered shift in the redox potential at the solid-liquid interface.

One application of the electrolytic component removal system is the recovery of solid minerals and ores from geologic media. Most economic ore deposits owe their genesis due to the adjective transport of solutes and heat by flowing groundwater. Ore deposits with this genesis include but are not limited to; Mississippi Valley-type (MVT) stratabound lead-zinc deposits, sediment-hosted and tabular uranium deposits, porphyry copper deposits, Nevada-type finely disseminated gold deposits, and others. The deposition of these ores is controlled by redox reactions of solutes in ground water occurring over geologic time scales.

MVT ore deposits are localized in areas where organic material containing reduced sulfur was available to induce precipitation of metals by reactions such as $Zn^{2+}H_2S = ZnS + 2H^+$ for sphalerite, $Pb^{2+} + H_2S + 2H^+$ for galena.

The dissolution, transport, and deposition of uranium are controlled by redox, with the solubility of uranium at +6 valence state about $10^4$ times higher than uranium at +4 valence state. Uranic ($U^{6+}$) or uranyl ($UO_2^{2+}$) ions for relatively soluble hydroxide, $UO_2OH^+$, the uranous ($U^{4+}$) ion reacts with bases to form insoluble hydroxide $U(OH)_4$. The uranium is dissolved where sufficient oxygen is available and deposited in reducing environments. The solubility of most ore mineral in water is generally low, but can be greatly enhanced by the formation of complex ions in relatively chloride- or sulfur-rich fluids. Ore deposits are found where the carrier fluid is induced to start precipitation by several processes; 1) pressure changes, 2) temperature changes, 3) reactions between hydrothermal fluids and the wall rock and 4) mixing of solutions with different compositions. The chemical reaction equations involve the generation of free electrons, and the reactions are reversible.

The treatment and processing of solid minerals can be performed either in the subsurface, acting on the geologic media using in-situ technologies, or on the surface with processing of the ore and recovery of entrapped minerals using ore processing technologies.

An example of subsurface component removal is given below in Example 1.

Example 1

An apparatus consisting of a column of packed sand, a fluid vessel, a pressure cylinder and a collection device is used to conduct the experiments. The sand column is constructed using clear or black PVC tubing and wrapped in heat tape for temperature control, with control and measurement apparatus at the inlet and outlet. The sand pack was prepared using unwashed, unsorted, sacked commercial sand consistent with experimental standards. The column is initially saturated with ~1% saline water for a minimum of one week to establish the initial solid-liquid wettability, and to remove entrained air prior to the initial displacement with hydrocarbon fluid.

The displacement and aging of the water-saturated column by hydrocarbon fluid yields a mixed wettability state. The injected solutions are placed into the pressurized fluid vessel and injected into the sand column. The displaced fluid volume is collected and measured by phase, oxidation/reduction potential eH, pH hydrocarbon/water volumes, and flowing phase fractions. These primary data are used to calculate additional flow behavior of the porous media.

The procedure begins with displacing ~1% saline water in the column at a rate of 1 to 4 ml/minute. The column has a total pore volume of 860 ml, measured by direct volume. Hydrocarbon fluid (e.g., kerosene, others) is injected until the media becomes saturated and water production at the discharge ceases, yielding 100% oil as the flowing phase, and establishing a residual water saturation to the hydrocarbon phase.

The pore space within the test column is immiscibly displaced with saline water until no additional hydrocarbons are recovered at the test column outlet, establishing a residual hydrocarbon saturation with the 100% water phase flowing. This cycle is repeated several times until consistent baseline results for each flowing phase are established.

The electrochemically altered solution is generated using a simple fluid ionizer. The ionizer consists of two conductive plates, a cathode and an anode, separated by a selectively permeable membrane. An electrical potential is applied to the cathode and anode. The fluid passing through the system acts as the conducting medium to electrify the carrier fluid. The electrical current density is used to adjust the redox potential, or eH, of the carrier fluid. Two fluid streams exited the ionizer, one with an excess of electrons and the other with a deficit of electrons.

After establishing a consistent baseline, the saline water was electrochemically altered by ionization to different eH potentials prior to being displaced through the column. The electrochemical potential of the saline water changed both the pH and redox potential of the two discharge streams. The hydrocarbon saturated column underwent more immiscible hydrocarbon displacement with the electrochemically altered carrier fluid than can be described by petroleum reservoir engineering theory.

The displacement of a hydrocarbon saturated column at residual water saturation was conducted under two electrochemical states; 1) a fluid having increased pH (alkaline) and a negative reduction potential (excess of electrons, −mV), and 2) a fluid having a decreased pH (acidic) and a positive reduction (oxidation) potential (deficient in electrons, +mV). A negative reduction in potential results in a significant increase in hydrocarbon recovery established by baseline tests of the same fluid without ionization.

The initial mixing of a ~1% NaCl solution was measured for temporal behavior. A set of eH measurements exhibited transient behavior approaching an asymptote with time prior to stabilization of the redox shift in the fluid. This transient behavior after mixing or dilution may cause shifts or repeatability issues with experimental results. This represents the "drift" encountered from association/disassociation, and its impact on eH over time. This drift means that, over time, a brine solution, such as a carrier fluid, will drift with respect to both pH and millivolts. This is an important observation because it will affect any baseline calculations for later adjustments. By knowing the baseline values for these two parameter drifts, proper adjustments for this drift can be made to optimize the ionized carrier fluid. Note the process asymptotes as time progresses. The results are presented graphically in FIG. 14 and in Table 1, below.

TABLE 1

Transient Response for a 1% Saline Fluid

| Day | Time | mV | pH |
|---|---|---|---|
| 1 | 8:20 a.m. | −3 | 7.06 |
| 1 | 10:20 a.m. | −5 | 7.09 |
| 1 | 2:30 p.m. | −9 | 7.15 |
| 1 | 8:00 p.m. | −15 | 7.25 |
| 2 | 8:30 a.m. | −19 | 7.3 |
| 2 | 8:00 p.m. | −25 | 7.43 |
| 3 | 7:00 a.m. | −27 | 7.46 |
| 4 | 12:00 p.m. | −36 | 7.57 |
| 5 | 1:00 p.m. | −40 | 7.69 |
| 8 | 5:30 p.m. | −45 | 7.77 |
| 11 | 5:15 p.m. | −48 | 7.82 |
| 14 | 6:00 p.m. | −53 | 7.83 |

Figure 15:
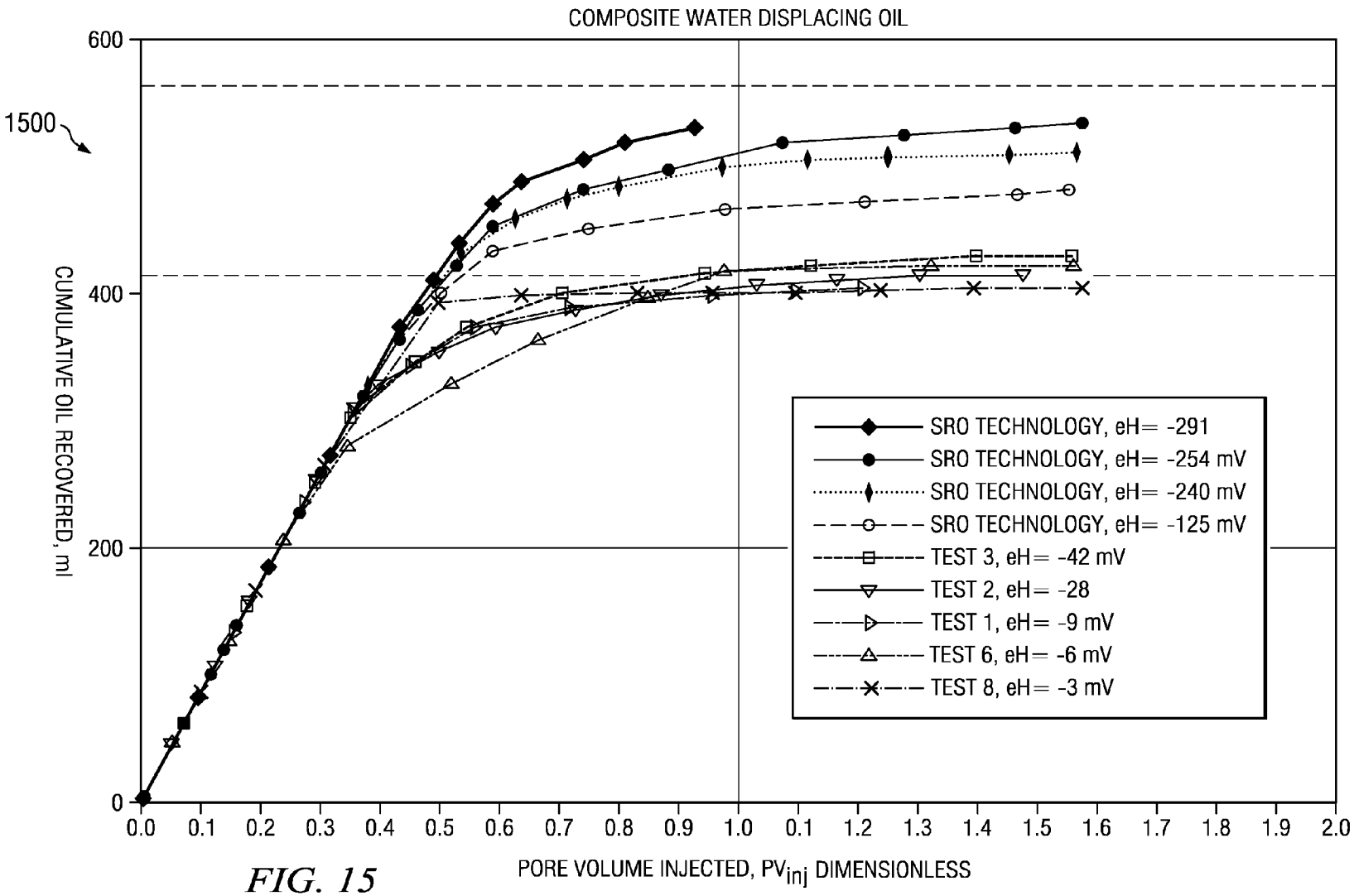
FIG. 15 illustrates a graphical representation of a two-phase recovery of Cumulative Oil Recovery versus Pore Volume of Injected Water according to an embodiment of the present invention.

The ionization of the ~1% NaCl binary saline solution prior to injection creates several beneficial changes to the fluid that promote hydrocarbon extraction; the reduction in interfacial tension between the water-hydrocarbon interface and the change in ζ-potential at the solid-liquid interface. The baseline fluid has a redox of −3 to −40 mV, and redox potentials between −125 mV and −291 mV are used to displace hydrocarbons within the test column for incremental oil recovery compared to the baseline results. The data is plotted to show the cumulative oil recovered at different eH values of the carrier fluid test column. The increase in redox potential shows a systematic significant increase in hydrocarbon recovery incremental to the baseline. Table 2 and the two-phase recovery plots in FIG. 15 present the relevant data.

TABLE 2

Hydrocarbon Recovery for each Displacement Cycle

| Run | Run* | Redox Potential (mV) | Hydrocarbon Recovery (mls) |
|---|---|---|---|
| Baseline | Cycle 1 | −9 | 403 |
| Baseline | Cycle 2 | −28 | 414 |
| Baseline | Cycle 3 | −42 | 429 |
| Ionized Solution | Cycle 4 | −125 | 481 |
| Ionized Solution | Cycle 5 | −254 | 534 |
| Re-baseline | Cycle 6 | −33 | 422 |
| Ionized Solution | Cycle 7 | −240 | 511 |
| Re-baseline | Cycle 8 | −3 | 403 |
| Ionized Solution | Cycle 9 | −291 | 530 |

*Each cycle consists of a water displacing hydrocarbon phase followed by hydrocarbon displacing water phase to re-establish hydrocarbons as the only mobile phase.

FIG. 15 shows a series of background measurements noted, "Test 3, Test 2, Test 1, Test 6, and Test 8" and the corresponding asymptote at just over 400 ml of cumulative recovered oil. The data reflecting the ionized carrier fluid is noted, "SRO Technology eH=291 mV, −254 mV, −240 mV, and −125 mV," which clearly shows the significantly improved cumulative oil recovery results due to the present electrolytic component removal system. The improved recovery results also reflect the asymptotic characteristic of the ionized carrier fluid that can be addressed by dynamically increasing the magnitude of the charge applied to the ionized carrier fluid as described herein, such as with the power control knob 904 of the power supply conditioning and network control interface unit 414.

Baseline criteria of a minimum of three consistent runs was used prior to introducing the carrier fluid with a controlled electrochemical potential. A clear and consistent trend of increasing hydrocarbon recovery with increasingly negative (reducing) redox potential shifts is experimentally observed. These results are consistent with the preceding theoretical discussion, verifying the invention, the electrolytic component removal system acts directly on the physical properties of a hydrocarbon-water containing porous media for the beneficial release of hydrocarbons and recovery by standard water flood operations.

The hydrocarbon-displacing-water cycle to re-saturation of the test column with hydrocarbon to a residual water saturation is achieved by injecting hydrocarbon at 2-5 ml/minute until the discharge fluid is 100% oil.

The residual oil saturation is controllable and reversible, and shifts in the endpoint residual saturation are consistent with immiscible displacement theory. Our ability to controllably and reversibly change water wettability is a key aspect of our claim of introducing, controlling, and understanding the removal or emplacement of hydrocarbons or other minerals in a porous media undergoing immiscible displacement.

Figure 14:
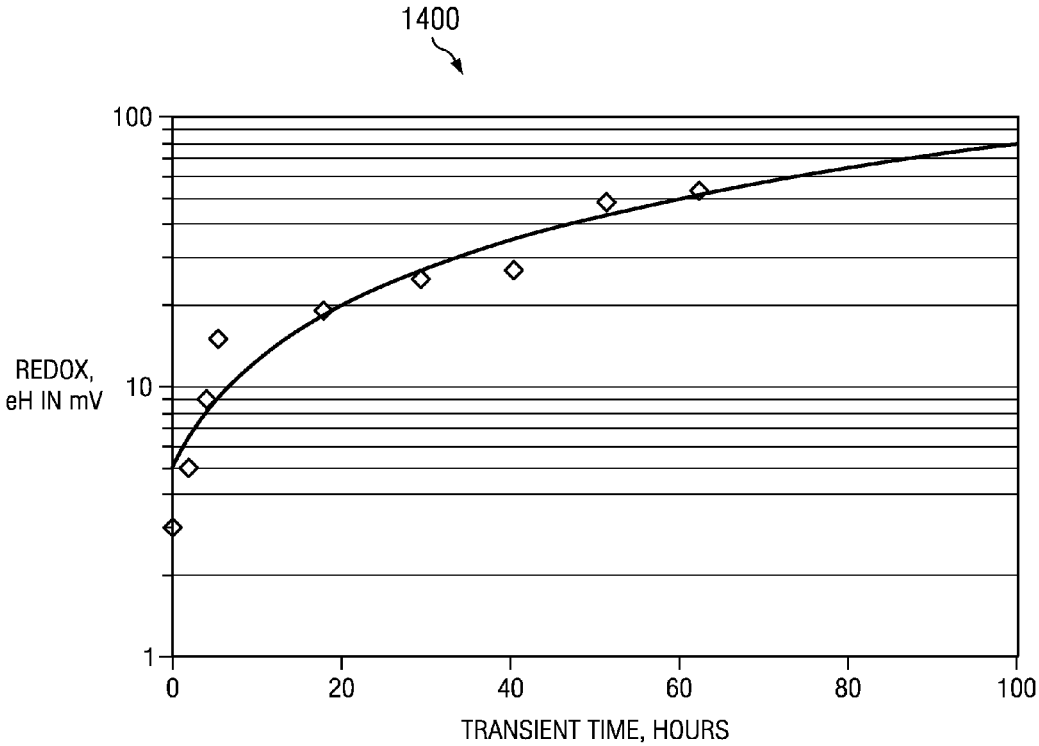
FIG. 14 illustrates a graphical representation of a set of reduction/oxidation (Redox) Potential Measurements versus time for a 1% saline carrier fluid according to an embodiment of the present invention.

In another aspect, the dilution of brine will have attributes of an alkaline flood, since the dilution of brine will raise the pH by lowering the residual oil saturation by the creation of a surfactant by reaction with the oil. FIG. 14 shows as a function of eH and time, with a long transient period before equilibrium is achieved as an asymptote develops, and may cause experimental and analytical difficulties for experimental repeatability.

Figure 16:
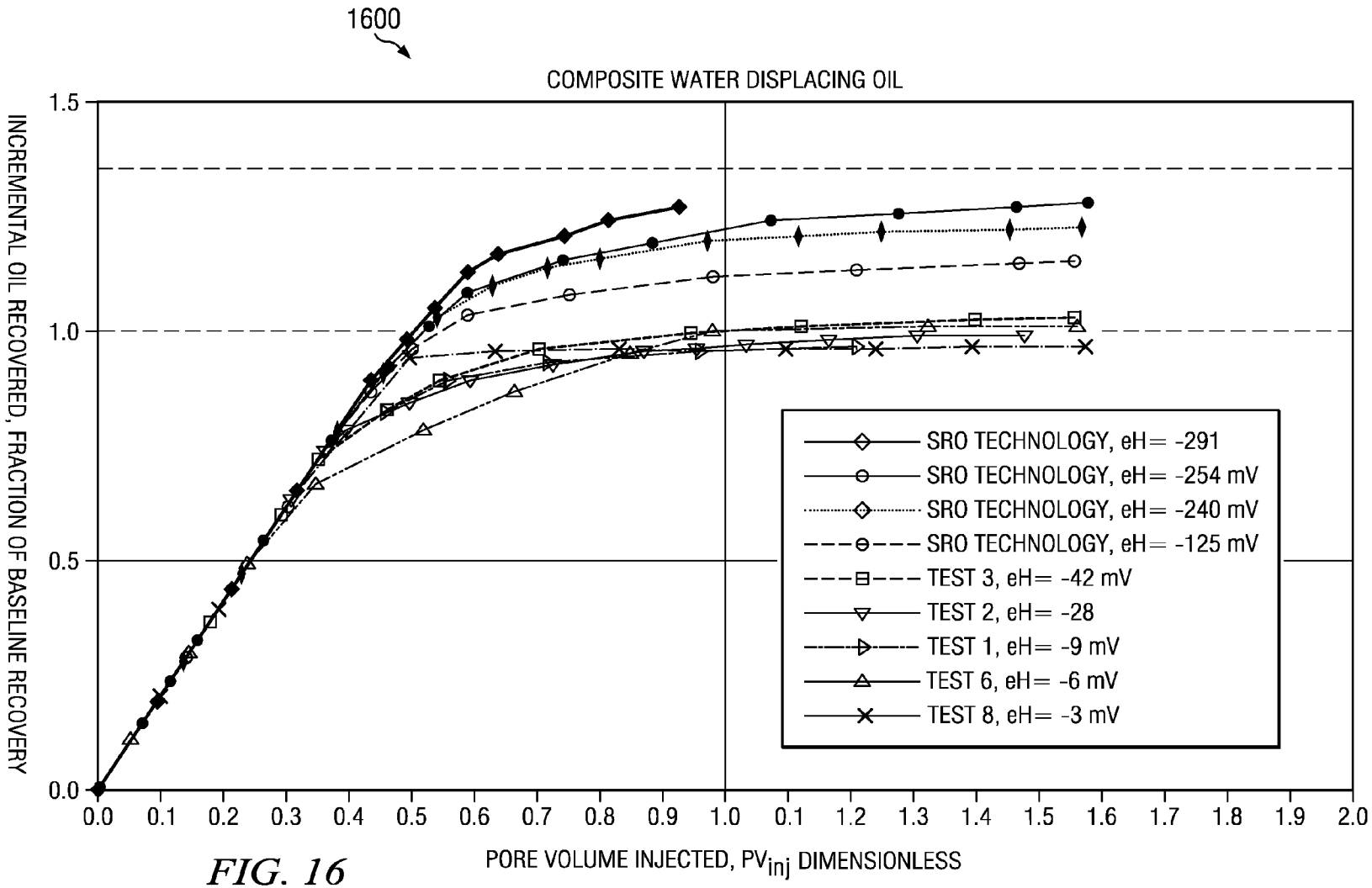
FIG. 16 illustrates a graphical representation of a two-phase recovery of Incremental Oil Recovery versus Pore Volume of Injected Water with increased redox potential of the injected water according to an embodiment of the present invention.

Typical baseline experimental results (see FIG. 14) show a consistent baseline from −3 to −42 mV, and a dramatic and significant increase in oil recovery when a carrier fluid having a negative redox potential is used to displace the hydrocarbons in the test column (see FIGS. 15 and 16). The experimental data demonstrate increased redox potential of the carrier fluid will increase hydrocarbon recovery. Other experiments demonstrate that this process is reversible, such that the injection of an oxidizing carrier fluid will lower hydrocarbon recovery due to a decrease in the water wettability to a more hydrocarbon wettable state, and a corresponding increase in the residual oil saturation. This process reversibility provides significant benefits through additional storage of hydrocarbons in "strategic" underground reserves, and the creation of underground "barriers" to prevent the unwanted migration of components into groundwater aquifers, for example. These results are consistent with the ζ-potential and the release or storage of the oleic phase in a porous media at the solid-liquid interface, depending on the redox potential of the injected fluid. FIG. 15 shows the experimental results of the baseline and of the present electrolytic component removal system, and the volume of hydrocarbon recovered in the test apparatus.

The consistent data set shows a positive relation between the redox potential of the carrier fluid and hydrocarbon recovery. The ζ-potential at the solid-liquid interface changes, and the wettability of the porous media adjusts (media becomes more water wet), thus electrostatically releasing bound hydrocarbons from the solid surface, capillaries, and pore surfaces.

Two physical processes are thus identified that increase oil recovery using an alkaline ionized water 1) the reduction in the contact angle between the solid-liquid and liquid-liquid interfaces, and 2) the change in the ζ-potential between the solid surface and the two phases due to the reduction in the interfacial tension between the two phases. The shift in the ζ-potential releases hydrocarbons bound by electrostatic forces by shifting the electrostatic potential to a more water-wet state. These two processes work synergistically at the pore surfaces, releasing oil by reducing the contact angle at the solid-liquid interface to allow physical expulsion of the oil from the pore surface by a change in ζ-potential. The wetting phase is physically dragged along the solid interface by a shift in potential. This released oil is then available for capture and transport by the existing hydraulic flow field to a discharge location. This oil recovery data set is viewed non-dimensionally using oil recovery as a fraction of the baseline recovery as presented in FIG. 16. This figure shows the results of baseline tests, the change in carrier fluid charge and the volume of hydrocarbon recovered as a function of the pore volume of fluid injected in the apparatus.

The benefits of the ionized carrier fluid was viewed experimentally using Denver Julesburg crude oil. A glass container and equal volumes of saline and saline ionized water are mixed with equal volumes of crude oil (approximately 50 mls of each and 50 mls of oil). The two containers are shaken simultaneously and set on the lab bench allowing the crude oil to drain to the bottom of a glass container. A much larger physical attraction to the glass surface by the crude oil is evident in the container to which the unaltered saline fluid is contained. The use of a reducing fluid with Denver Julesburg crude oil shows the favorable change in wettability to the baseline saline water-crude oil mixture.

Figure 17:
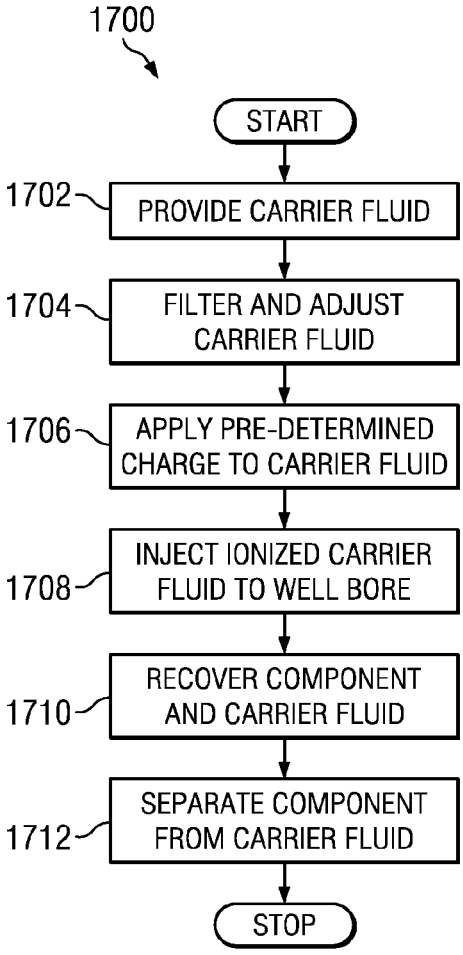
FIG. 17 illustrates a flow diagram of an exemplary process for recovering subsurface components according to an embodiment of the present invention.

In addition to the aforementioned aspects included in and embodiments of the present electrolytic component removal system, the present electrolytic component removal system further includes methods for extracting subsurface and ex-situ components. FIG. 17 illustrates a flow diagram of an embodiment 1700 of one such process. In step 1702, a carrier fluid is provided to the carrier fluid conditioning subsystem. The carrier fluid is pumped to the carrier fluid conditioning subsystem from a storage tank or other storage system. In step 1704, the carrier fluid is filtered at the filtering unit 420 on its way to the pumping station 404. The filtering unit 420 removes any large pieces of debris from the carrier fluid to prevent damage to the ionization unit 408. Additionally, any adjustments to the carrier fluid can be conducted at this point if necessary. These adjustments may be in the form of mineral addition (or removal) from the carrier fluid. Additionally, materials such as nano-particles may be added to enhance the ability of the carrier fluid to be ionized or carry a charge.

In the preferred embodiment in step 1706, a charge is provided to the carrier fluid by flowing the carrier fluid between an anode electrode 604 and a cathode electrode 606 separated by a permeable membrane 702. A desired charge is applied to the electrodes. As described above, the amount of charge placed on the carrier fluid is determined by the specific application, and include determinations such as the flow rate of the carrier fluid through the insulated housing 504, the charge potential between the two electrode plates 604 and 606, the carrier fluid residence time, and the amperage used to ionize the carrier fluid.

This invention also includes other configurations of an ionization apparatus that could include systems using simple electrolysis with or without a membrane (e.g., ported systems or other configuration), variations in plate materials/configurations or any other embodiment that is able to produce an ionized fluid adequate to generate beneficial results during the extraction process.

In step 1708, the ionized carrier fluid is pumped to a set of injection pumps 104 that then further pump the ionized carrier fluid to their respective injection wells 106. In step 1710, the combined recovered component and carrier fluid is pumped from the production well 108 and then sent to a separation unit 112. In step 1712, the component, such as oil, is separated from the carrier fluid and pumped to product tanks 122 and 126 for storing, or pumped directly into a pipeline or transmission line to be sent downstream for further processing. The carrier fluid may then be stored in a storage tank 114 prior to being pumped to the carrier fluid conditioning subsystem 102 or may be pumped directly to the carrier fluid conditioning subsystem 102.

Figure 18:
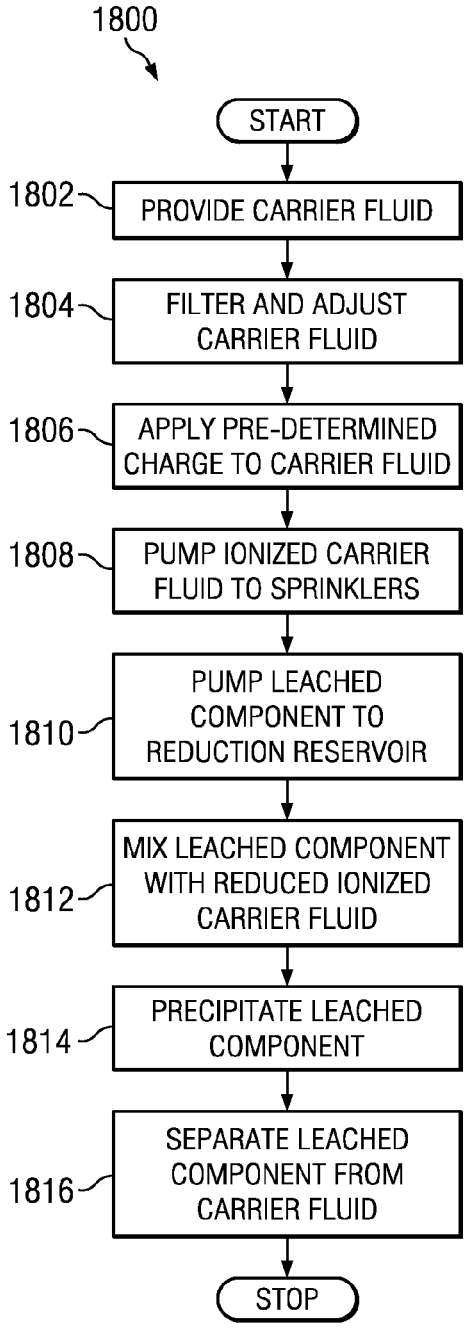
FIG. 18 illustrates a flow diagram of an exemplary process for recovering ex-situ components according to an embodiment of the present invention.

FIG. 18 illustrates a flow diagram of an embodiment 1800 of an ex-situ process. In step 1802, a carrier fluid is provided to the carrier fluid conditioning subsystem. The carrier fluid can be pumped to the carrier fluid conditioning subsystem from a storage tank and the like. In step 1804, the carrier fluid is filtered at the filtering unit 420 on its way to the pumping station 404. The filtering unit 420 removes any large pieces of debris from the carrier fluid to prevent damage to the ionization unit 408. Additionally, any adjustments to the carrier fluid can be conducted at this point if necessary. These adjustments may be in the form of mineral addition or removal from the carrier fluid. Additionally, materials such as nano-particles may be added to enhance the ability of the carrier fluid to be ionized or carry a charge.

In step 1806, a charge is provided to the carrier fluid by flowing the carrier fluid between an anode electrode 604 and a cathode electrode 606 separated by a permeable membrane 702. A desired charge is applied to the electrodes. As described above, the amount of charge placed on the carrier fluid is determined by the specific application, and include determinations such as the flow rate of the carrier fluid through the insulated housing 504, the charge potential between the two electrode plates 604 and 606, the carrier fluid residence time, and the amperage used to ionize the carrier fluid.

In step 1808, the ionized carrier fluid is pumped to a set of sprinklers 308. In this embodiment, the carrier fluid conditioning subsystem 102 ionizes the carrier fluid in an oxidizing state. The sprinklers 308 distribute the ionized carrier fluid to the top of an ore deposit 306 in an ex-situ heap leach process. The ionized carrier fluid then flows downward through the ore deposit 306 that then leaches the mineral, such as uranium, from the ore deposit 306. The leached mineral is then pumped over to a "pregnant pond" 312 where it is further mixed with a carrier fluid in a reducing state that causes the extracted minerals to precipitate for easy collection. The carrier fluids are then recycled through the carrier fluid conditioning subsystem 102 and reused (make up water and adjustments may be required). Other minerals may be extracted by this ex-situ process, including sulfur from coal, uranium roll-front deposits, disseminated gold deposits, 'Missouri valley'-type ore deposits or other substances where an introduced change in charge potential will result in the recovery of a substance with economic utility.

SUMMARY

An embodiment of the present electrolytic system and method for extracting components includes a means for providing a carrier fluid; a means for providing a pair of electrodes interposed by a permeable membrane or other configuration to create a first channel and a second channel; a means for flowing the carrier fluid through the first and second channel; a means for applying an electrical potential to the pair of electrodes to produce a first ionized carrier fluid in the first channel and a second ionized carrier fluid in the second channel; a means for injecting at least one of the first ionized carrier fluid and the second ionized carrier fluid into the subsurface reservoir to release the components; and a means for recovering at least one of the first ionized carrier fluid and the second ionized carrier fluid and the components from a subsurface strata or ex-situ mineral deposit.

There has herein been described a novel system and method for removing subsurface and/or ex-situ components. It should be understood that the particular embodiments described within this specification are for purposes of example and should not be construed to limit the invention. Further, it is evident that those skilled in the art may now make numerous uses and modifications of the specific embodiment described, without departing from the inventive concepts. For example, the carrier fluid that is described can be any type of fluid useable for a desired application such as described herein. It is also evident that the process steps recited may in some instances be performed in a different order, or equivalent structures and processes may be substituted for the various structures and processes described. The structures and processes may be combined with a wide variety of other structures and processes.

What is claimed:

1. An electrolytic method for extracting components from a subsurface strata comprising:

providing a carrier fluid;

providing a pair of electrodes interposed by a permeable membrane to create a first channel and a second channel;

flowing said carrier fluid through said first and second channel;

applying a potential to said pair of electrodes to produce a first ionized carrier fluid in said first channel and a second ionized carrier fluid in said second channel;

injecting at least one of said first ionized carrier fluid and said second ionized carrier fluid into said subsurface strata to release said components; and recovering said at least one of said first ionized carrier fluid and said second ionized carrier fluid and said components from said subsurface strata.

2. The electrolytic method for extracting components of claim 1 further comprising:

separating said components from said at least one of said first ionized carrier fluid and said second ionized carrier fluid.

3. The electrolytic method for extracting components of claim 1 wherein said injecting further includes injecting said at least one of said first ionized carrier fluid and said second ionized carrier fluid into at least one injection well located to provide Darcy flow principles to said subsurface reservoir.

4. The electrolytic method for extracting components of claim 3 wherein said recovering further includes recovering said at least one of said first ionized carrier fluid and said second ionized carrier fluid with a production well located central to said at least one injection wells to provide Darcy flow principles to said subsurface reservoir.

5. The electrolytic method for extracting components of claim 1 wherein said flowing further comprises:

adjusting said flowing of said carrier fluid to change the magnitude of charge on said first ionized carrier fluid and said second ionized carrier fluid.

6. The electrolytic method for extracting components of claim 1 wherein said applying further comprises:

adjusting said potential to change the magnitude of charge on said first ionized carrier fluid and said second ionized carrier fluid.

7. The electrolytic method for extracting components of claim 1 wherein said providing a pair of electrodes further comprises:

adjusting the location of said permeable membrane relative to said pair of electrodes to change the volume of said first ionized carrier fluid relative to said second ionized carrier fluid.

8. The electrolytic method for extracting components of claim 1 further comprising:

monitoring at least one of pH and eH of said first ionized carrier fluid and said second ionized carrier fluid.

9. The electrolytic method for extracting components of claim 1 further comprising:

reversing the polarity of said applied potential to said pair of electrodes.

10. The electrolytic method for extracting components of claim 1 wherein at least one of said first ionized carrier fluid and said second ionized carrier fluid has a negative reduction potential.

11. The electrolytic method for extracting components of claim 1 wherein at least one of said first ionized carrier fluid and said second ionized carrier fluid comprises a positive oxidation potential.

12. The electrolytic method for extracting components of claim 1 further comprising:

filtering said carrier fluid.

13. The electrolytic method for extracting components of claim 1 further comprising:

adjusting the mineral content of said carrier fluid.

14. The electrolytic method for extracting components of claim 13 wherein said adjusting comprises:

adding or removing a component of the group consisting of clay particulates and nano particles.

15. An electrolytic system for extracting components from a subsurface strata comprising:

means for providing a carrier fluid;

means for providing a pair of electrodes interposed by a permeable membrane to create a first channel and a second channel;

means for flowing said carrier fluid through said first and second channel;

means for applying a potential to said pair of electrodes to produce a first ionized carrier fluid in said first channel and a second ionized carrier fluid in said second channel;

means for injecting at least one of said first ionized carrier fluid and said second ionized carrier fluid into said subsurface reservoir to release said components; and means for recovering said at least one of said first ionized carrier fluid and said second ionized carrier fluid and said components from said subsurface strata.

16. The electrolytic system for extracting components of claim 15 further comprising:

means for separating said components from said at least one of said first ionized carrier fluid and said second ionized carrier fluid.

17. The electrolytic system for extracting components of claim 15 wherein said means for injecting further includes means for injecting said at least one of said first ionized carrier fluid and said second ionized carrier fluid into at least one injection well located to provide Darcy flow principles to said subsurface reservoir.

18. The electrolytic system for extracting components of claim 17 wherein said means for recovering further includes recovering said at least one of said first ionized carrier fluid and said second ionized carrier fluid with a production well located central to said at least one injection well to provide Darcy flow principles to said subsurface reservoir.

19. The electrolytic system for extracting components of claim 15 wherein said means for flowing further comprises:

means for adjusting said flowing of said carrier fluid to change the magnitude of charge on said first ionized carrier fluid and said second ionized carrier fluid.

20. The electrolytic system for extracting components of claim 15 wherein said means for applying further comprises:

means for adjusting said potential to change the magnitude of charge on said first ionized carrier fluid and said second ionized carrier fluid.

21. The electrolytic system for extracting components of claim 15 wherein said means for providing a pair of electrodes further comprises:

means for adjusting the location of said permeable membrane relative to said pair of electrodes to change the volume of said first ionized carrier fluid relative to said second ionized carrier fluid.

22. The electrolytic system for extracting components of claim 15 further comprising:

means for monitoring at least one of pH and eH of said first ionized carrier fluid and said second ionized carrier fluid.

23. The electrolytic system for extracting components of claim 15 further comprising:

means for reversing the polarity of said applied potential to said pair of electrodes.

24. The electrolytic system for extracting components of claim 15 wherein at least one of said first ionized carrier fluid and said second ionized carrier fluid has a negative reduction potential.

25. The electrolytic system for extracting components of claim 15 wherein at least one of said first ionized carrier fluid and said second ionized carrier fluid comprises a positive reduction potential.

26. The electrolytic system for extracting components of claim 15 further comprising:

means for filtering said carrier fluid.

27. The electrolytic system for extracting components of claim 15 further comprising:

means for adjusting the mineral content of said carrier fluid.

28. An electrolytic method for extracting components from an ex-situ mineral deposit comprising:

providing a carrier fluid;

providing a pair of electrodes interposed by a permeable membrane to create a first channel and a second channel;

flowing said carrier fluid through said first and second channel;

applying a voltage to said pair of electrodes to produce a first ionized carrier fluid in said first channel and a second ionized carrier fluid in said second channel;

percolating at least one of said first ionized carrier fluid and said second ionized carrier fluid through said ex-situ mineral deposit to release said components; and recovering said at least one of said first ionized carrier fluid and said second ionized carrier fluid and said components from said above.

29. The electrolytic method for extracting components of claim 28 further comprising:

separating said components from said at least one of said first ionized carrier fluid and said second ionized carrier fluid.

30. The electrolytic method for extracting components of claim 28 wherein said flowing further comprises:

adjusting said flowing of said carrier fluid to change the magnitude of charge on said first ionized carrier fluid and said second ionized carrier fluid.

31. The electrolytic method for extracting components of claim 28 wherein said applying further comprises:

adjusting said voltage to change the magnitude of charge on said first ionized carrier fluid and said second ionized carrier fluid.

32. The electrolytic method for extracting components of claim 28 wherein said providing a pair of electrodes further comprises:

adjusting the location of said permeable membrane relative to said pair of electrodes to change the volume of said first ionized carrier fluid relative to said second ionized carrier fluid.

33. The electrolytic method for extracting components of claim 28 further comprising:

monitoring at least one of pH and eH of said first ionized carrier fluid and said second ionized carrier fluid.

34. The electrolytic method for extracting components of claim 28 further comprising:

reversing the polarity of said applied voltage to said pair of electrodes.

35. The electrolytic method for extracting components of claim 28 wherein at least one of said first ionized carrier fluid and said second ionized carrier fluid has a negative reduction potential.

36. The electrolytic method for extracting components of claim 28 wherein at least one of said first ionized carrier fluid and said second ionized carrier fluid comprises a positive reduction potential.

37. The electrolytic method for extracting components of claim 28 further comprising:

filtering said carrier fluid.

38. The electrolytic method for extracting components of claim 28 further comprising:

adjusting the mineral content of said carrier fluid.

* * * * *